US012667237B2

(12) United States Patent
Teuscher et al.

(10) Patent No.: US 12,667,237 B2
(45) Date of Patent: Jun. 30, 2026

(54) ROBOTIC CLEANER AND METHODS OF OPERATING THE SAME

(71) Applicant: SHARKNINJA OPERATING LLC, Needham, MA (US)

(72) Inventors: Scott Teuscher, Advance, NC (US); John Lewis, Littleton, MA (US)

(73) Assignee: SharkNinja Operating LLC, Needham, MA (US)

( * ) Notice: Subject to any disclaimer, the term of this patent is extended or adjusted under 35 U.S.C. 154(b) by 381 days.

(21) Appl. No.: 18/133,779

(22) Filed: Apr. 12, 2023

(65) Prior Publication Data

US 2023/0320550 A1 Oct. 12, 2023

Related U.S. Application Data

(60) Provisional application No. 63/330,082, filed on Apr. 12, 2022.

(51) Int. Cl.

| | |
|---|---|
| ***A47L 9/28*** | (2006.01) |
| ***A47L 5/14*** | (2006.01) |
| ***A47L 7/04*** | (2006.01) |

(52) U.S. Cl.

CPC ..... *A47L 9/2842* (2013.01); *A47L 5/14* (2013.01); *A47L 7/04* (2013.01); *A47L 9/2805* (2013.01); *A47L 9/2847* (2013.01); *A47L 9/2852* (2013.01); *A47L 2201/04* (2013.01); *A47L 2201/06* (2013.01)

(58) Field of Classification Search

CPC ..... A47L 5/14; A47L 7/04; A47L 9/08; A47L 9/2805; A47L 9/2836; A47L 9/2842; A47L 9/2847; A47L 9/0488; A47L 2201/04; A47L 2201/06

See application file for complete search history.

(56) References Cited

U.S. PATENT DOCUMENTS

| | | | |
|---|---|---|---|
| 2,064,344 | A | 12/1936 | Good |
| 3,663,984 | A | 5/1972 | Anthony et al. |
| 3,694,848 | A | 10/1972 | Alcala |
| 3,963,515 | A | 6/1976 | Haldeman et al. |
| 4,070,586 | A | 1/1978 | Breslin |
| 4,300,261 | A | 11/1981 | Woodward et al. |
| 4,315,344 | A | 2/1982 | Woodward et al. |
| 4,393,536 | A | 7/1983 | Tapp |

(Continued)

FOREIGN PATENT DOCUMENTS

| | | |
|---|---|---|
| CN | 1451347 | 10/2003 |
| CN | 101708116 B | 3/2012 |

(Continued)

OTHER PUBLICATIONS

US 8,266,760 B2, 09/2012, Morse et al. (withdrawn)

(Continued)

*Primary Examiner* — David S Posigian
*Assistant Examiner* — Steven Huang
(74) *Attorney, Agent, or Firm* — Secant IP, P.L.L.C.

(57) ABSTRACT

A robotic cleaner may include one or more driven wheels, one or more sensors configured to detect one or more features of an environment, an air jet assembly configured to generate an air jet, and a side brush, a side brush operational state of the side brush corresponding to an air jet operational state of the air jet assembly.

6 Claims, 11 Drawing Sheets

(56) References Cited

U.S. PATENT DOCUMENTS 4,884,315 A 12/1989 Ehnert
5,613,269 A 3/1997 Miwa
5,647,092 A 7/1997 Miwa
6,237,188 B1 5/2001 Takemoto et al.
6,324,722 B1 12/2001 Takemoto
6,725,500 B2 4/2004 Allen et al.
6,732,404 B2 5/2004 Fukuoka et al.
7,059,012 B2 6/2006 Song et al.
7,225,500 B2 6/2007 Diehl et al.
7,231,687 B2 6/2007 Rew et al.
7,458,130 B1 12/2008 Krymsky et al.
7,555,812 B1 7/2009 Pinney
7,610,651 B2 11/2009 Baek
7,620,476 B2 11/2009 Morse et al.
7,665,181 B2 2/2010 Gebhard et al.
7,761,954 B2 7/2010 Ziegler
7,788,765 B2 9/2010 Allen
7,937,800 B2 5/2011 Yan
8,468,645 B2 6/2013 Kim et al.
8,739,355 B2 6/2014 Morse et al.
8,782,848 B2 7/2014 Ziegler et al.
8,966,707 B2 3/2015 Morse et al.
9,327,407 B2 5/2016 Jones et al.
9,801,510 B2 10/2017 Weiburg et al.
9,854,956 B2 1/2018 Song et al.
10,357,137 B2 7/2019 Holz
10,398,273 B2 9/2019 Watanabe et al.
10,470,629 B2 11/2019 Ziegler et al.
10,602,893 B2 3/2020 Isenberg et al.
10,624,516 B2 4/2020 Cudzilo
10,694,908 B2 6/2020 Yan
10,863,878 B2 12/2020 Royce
11,076,730 B2 8/2021 Lee et al.
2002/0184730 A1 12/2002 Allen et al.
2003/0192144 A1 10/2003 Song et al.
2004/0255425 A1 12/2004 Arai et al.
2005/0251292 A1* 11/2005 Casey ..... G05D 1/0242 700/245
2006/0190132 A1 8/2006 Morse et al.
2006/0190133 A1 8/2006 Konandreas et al.
2006/0236491 A1 10/2006 Baek
2007/0039123 A1 2/2007 Bird
2007/0074371 A1 4/2007 Song et al.
2007/0089262 A1 4/2007 Drevitson et al.
2008/0000043 A1 1/2008 Frederickson
2008/0307602 A1 12/2008 Andriolo et al.
2009/0089964 A1 4/2009 Vanderlinden
2010/0088840 A1 4/2010 Kim et al.
2011/0214246 A1 9/2011 Marshall et al.
2012/0260454 A1 10/2012 Lester
2013/0058635 A1 3/2013 Vrdoljak
2013/0067680 A1* 3/2013 Yoshida ..... A47L 9/08 15/345
2013/0152337 A1 6/2013 Thorne
2014/0150201 A1 6/2014 McGee et al.
2014/0230179 A1 8/2014 Matsubara et al.
2015/0013102 A1 1/2015 Bilger
2015/0040340 A1 2/2015 Bilger et al.
2015/0135474 A1 5/2015 Gidwell
2015/0297054 A1 10/2015 Weeks et al.
2015/0351596 A1 12/2015 Thorne
2016/0051111 A1 2/2016 Lee
2016/0066754 A1 3/2016 Haegermarck
2016/0095486 A1 4/2016 Al Salameh
2016/0128530 A1 5/2016 Thorne et al.
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0354931 A1 12/2016 Jones et al.
2016/0374533 A1 12/2016 Innes et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0215667 A1 8/2017 Thorne et al.
2017/0215668 A1 8/2017 Lubbers et al.
2017/0260704 A1 9/2017 De Geyter
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 3/2018 Udy et al.
2018/0184866 A1 7/2018 Gebhard et al.
2018/0192834 A1* 7/2018 Isenberg ..... A47L 5/14
2018/0255991 A1 9/2018 Der Marderosian et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0167052 A1* 6/2019 Lee ..... A47L 9/0027
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0302793 A1 10/2019 Leech et al.
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2019/0374081 A1 12/2019 Michael et al.
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0037833 A1 2/2020 Niedzwecki et al.
2020/0037843 A1 2/2020 Fiebig et al.
2020/0046184 A1 2/2020 Freese et al.
2020/0077855 A1 3/2020 Brown et al.
2020/0085267 A1 3/2020 Thorne et al.
2020/0085269 A1 3/2020 Thorne
2020/0121144 A1 4/2020 Gacin et al.
2020/0121148 A1 4/2020 Hoffman et al.
2020/0138260 A1 5/2020 Sutter et al.
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0237171 A1 7/2020 Xu et al.
2020/0288929 A1 9/2020 Brunner
2020/0288930 A1 9/2020 Wells
2020/0297172 A1 9/2020 Tonderys et al.
2020/0301430 A1 9/2020 Irkliy et al.
2020/0315418 A1 10/2020 Howard et al.
2020/0345196 A1 11/2020 Innes et al.
2020/0367711 A1 11/2020 Thorne et al.
2020/0371526 A1 11/2020 Kamada
2020/0383547 A1 12/2020 Sutter et al.
2021/0007569 A1 1/2021 Howard et al.
2021/0022574 A1 1/2021 Harting
2021/0030227 A1 2/2021 Mathieu et al.
2021/0038032 A1 2/2021 Brown
2021/0059495 A1 3/2021 Gill et al.
2021/0085144 A1 3/2021 Woodrow et al.
2021/0169289 A1 6/2021 Thorne et al.
2021/0175772 A1 6/2021 Aini
2021/0177223 A1 6/2021 Der Marderosian et al.
2021/0186282 A1 6/2021 Mathieu et al.
2021/0204684 A1 7/2021 Heman-Ackah et al.
2021/0254615 A1 8/2021 Vrdoljak et al.
2021/0307581 A1 10/2021 Thorne et al.
2021/0315428 A1 10/2021 Udy et al.
2021/0386261 A1 12/2021 Woodrow et al.

(56) References Cited

U.S. PATENT DOCUMENTS

| | | | |
|---|---|---|---|
| 2021/0386262 | A1 | 12/2021 | Uchendu et al. |
| 2022/0031131 | A1 | 2/2022 | McClay et al. |
| 2022/0031133 | A1 | 2/2022 | Der Marderosian et al. |
| 2022/0031134 | A1 | 2/2022 | Yang et al. |
| 2022/0061614 | A1 | 3/2022 | Yu et al. |
| 2022/0071459 | A1 | 3/2022 | Gacin et al. |
| 2022/0095864 | A1 | 3/2022 | Der Marderosian et al. |
| 2022/0125256 | A1 | 4/2022 | Lessard et al. |
| 2022/0287521 | A1 | 9/2022 | Cottrell et al. |
| 2022/0322903 | A1 | 10/2022 | Lessard |
| 2022/0400922 | A1 | 12/2022 | McClay et al. |
| 2022/0408994 | A1 | 12/2022 | Hill |
| 2023/0043567 | A1 | 2/2023 | Copeland et al. |
| 2023/0070147 | A1 | 3/2023 | Harting et al. |
| 2023/0157495 | A1 | 5/2023 | Copeland et al. |
| 2023/0248192 | A1 | 8/2023 | Brown et al. |
| 2023/0320550 | A1 | 10/2023 | Teuscher et al. |
| 2023/0329502 | A1 | 10/2023 | Chirikjian |
| 2023/0355065 | A1 | 11/2023 | Finnegan |
| 2023/0414052 | A1 | 12/2023 | McClay et al. |
| 2024/0008699 | A1 | 1/2024 | Innes et al. |
| 2024/0415352 | A1 | 12/2024 | McClay et al. |

FOREIGN PATENT DOCUMENTS

| | | | | |
|---|---|---|---|---|
| CN | 208002736 | | 10/2018 | |
| CN | 109480716 | | 3/2019 | |
| CN | 208864216 | | 5/2019 | |
| CN | 210697497 | | 6/2020 | |
| CN | 111358331 | | 7/2020 | |
| CN | 211484377 | | 9/2020 | |
| CN | 211534208 | U | 9/2020 | |
| CN | 211534245 | | 9/2020 | |
| CN | 108403007 | | 10/2020 | |
| CN | 212661761 | | 3/2021 | |
| CN | 110811434 | | 12/2021 | |
| CN | 215738679 | | 2/2022 | |
| CN | 114206182 | | 3/2022 | |
| DE | 102014105756 | | 10/2015 | |
| DE | 202017100064 | U1 * | 4/2018 | ..... A47L 5/14 |
| DE | 202017100064 | | 5/2018 | |
| DE | 102017208965 | | 11/2018 | |
| DE | 112008001234 | | 4/2021 | |
| EP | 1850725 | | 5/2010 | |
| EP | 1716801 | | 7/2013 | |
| EP | 3194660 | | 10/2018 | |
| EP | 3189384 | | 6/2019 | |
| EP | 3100659 | | 11/2020 | |
| ES | 2712425 | | 5/2019 | |
| ES | 2746858 | | 3/2020 | |
| JP | H0711611 | A * | 1/1995 | |
| JP | H0889448 | | 4/1996 | |
| JP | 2006026028 | | 2/2006 | |
| JP | 2007029488 | | 2/2007 | |
| JP | 2013223650 | | 10/2013 | |
| JP | 2014188001 | | 10/2014 | |
| JP | 2016201096 | | 12/2016 | |
| JP | 6378984 | B2 * | 8/2018 | ..... A47L 9/00 |
| KR | 200317875 | Y1 * | 6/2003 | ..... A47L 9/08 |
| KR | 100549042 | | 2/2006 | |
| KR | 20060111788 | A * | 10/2006 | ..... E03B 3/12 |
| KR | 20090129030 | A * | 12/2009 | ..... A47L 9/2805 |
| WO | 2015012602 | | 1/2015 | |
| WO | 2016038918 | | 3/2016 | |
| WO | 2019112249 | | 6/2019 | |
| WO | 2022221274 | | 10/2022 | |

OTHER PUBLICATIONS

Translation of JP 6378984 B2 (Year: 2018).*
Translation of DE 202017100064 U1 (Year: 2018).*
Translation of KR 20060111788 A (Year: 2006).*
Translation of JP H0711611 A (Year: 1995).*
Translation of KR 20090129030 A (Year: 2009).*
Translation of KR 200317875 Y1 (Year: 2003).*
PCT International Search Report and Written Opinion mailed Dec. 21, 2017, received in PCT/US17/56484, 8 pgs.
Chinese Office Action with English translation issued Jul. 31, 2020, received in Chinese Patent Application No. 201780075887.2, 13 pgs.
Chinese Office Action with English translation issued Jan. 12, 2021, received in Chinese Patent Application No. 201780075887.2, 9 pages.
Chinese Decision of Rejection with English translation issued May 26, 2021, received in Chinese Patent Application No. 201780075887.2, 8 pages.
U.S. Office Action mailed Jun. 18, 2021, received in U.S. Appl. No. 16/341,575, 7 pages.
Chinese First Notification to Make Rectification with English translation issued May 31, 2021, received in Chinese Utility Patent Application No. 20202163160.9, 2 pages.
U.S. Office Action mailed Nov. 23, 2021, received in U.S. Appl. No. 16/341,575, 23 pages.
Chinese Office Action with English translation issued Jul. 11, 2022, received in Chinese Patent Application No. 202080056292.4, 23 pages.
U.S. Office Action mailed Sep. 6, 2022, received in U.S. Appl. No. 16/341,575, 25 pages.
PCT Search Report and Written Opinion, mailed Oct. 20, 2020, received in corresponding PCT Application No. PCT/US2020/45374, 9 pages.
U.S. Office Action mailed Aug. 18, 2022, received in U.S. Appl. No. 16/987,801, 14 pages.
U.S. Office Action mailed Dec. 1, 2022, received in U.S. Appl. No. 16/987,801, 15 pages.
PCT Search Report and Written Opinion mailed Jul. 1, 2022, received in corresponding PCT Application No. PCT/US22/24413, 9 pages.
Canadian Office Action issued Mar. 7, 2023, received in Canadian Patent Application No. 3,150,282, 4 pages.
US Office Action mailed Dec. 30, 2022, received in U.S. Appl. No. 16/341,575, 33 pages.
Chinese Office Action with machine-generated English translation issued Nov. 29, 2024, received in Chinese Patent Application No. 202080056292.4, 24 pages.
Chinese Office Action with machine-generated English translation issued Aug. 23, 2023, received in Chinese Patent Application No. 202080056292.4, 24 pages
PCT Search Report and Written Opinion mailed Sep. 27, 2023, received in PCT Application No. PCT/US2023/018306, 12 pages.
Chinese Office Action with machine-generated English translation dated May 24, 2023, received in Chinese Patent Application No. 202080056292.4, 24 pages.
PCT Search Report and Written Opinion mailed Jun. 30, 2023, received in PCT Application No. PCT/US2023/018301, 13 pages.
European Search Report issued Aug. 3, 2023, received in European Patent Application No. 20849948.3, 8 pages.
US Office Action issued Aug. 22, 2024, received in U.S. Appl. No. 17/718,901, 15 pages.
Chinese Office Action with machine-generated English translation issued Nov. 27, 2023, received in Chinese Patent Application No. 202320800992.0, 18 pages.
Chinese Office Action with machine-generated English translation issued Nov. 22, 2023, received in Chinese Patent Application No. 202080056292.4, 21 pages.
Extended European Search report dated Mar. 20, 2025, received in European Patent Application No. 22788768.4, with English translation of JP2016201096 patent document annexed to report, 46 pages.
U.S. Office Action issued Jun. 3, 2025, received in U.S. Appl. No. 18/133,761, 21 pages.
Japanese Notice of Reasons for Refusal with machine-generated English translation, dated Sep. 30, 2025, received in Japanese Patent Application No. 2024-560477, 10 pages.
Australian Examination Report issued Nov. 11, 2025, received in Australian Patent Application No. 2023251965, 5 pages.

(56) References Cited

OTHER PUBLICATIONS

European Communication pursuant to Article 94(3) EPC issued Feb. 4, 2026, received in European Patent Application No. 22788768.4, 8 pages.
European partial supplementary Search Report issued Mar. 12, 2026, received in European Patent Application No. 23788895.3, 13 pages.

* cited by examiner 604
601
602
606
600
608
603

604
601
602
600
608
603

602
603
610
606
604
600
601

602
603
606
600
604
601

602
606
600
604

ROBOTIC CLEANER AND METHODS OF OPERATING THE SAME

CROSS-REFERENCE TO RELATED APPLICATIONS

The present application claims the benefit of U.S. Provisional Application Ser. No. 63/330,082 filed on Apr. 12, 2022, entitled Robotic Cleaner and Methods of Operating the same, which is fully incorporated herein by reference.

TECHNICAL FIELD

The present disclosure generally relates to surface cleaning apparatuses, and more particularly, to a robotic cleaner.

BACKGROUND INFORMATION

Robotic cleaners are configured to autonomously traverse a surface to be cleaned (e.g., a floor). For example, a robotic vacuum cleaner may include a suction motor configured to draw debris from the surface to be cleaned into a dust cup of the robotic vacuum cleaner for later disposal. In some instances, the robotic cleaner may include one or more side cleaning implements (e.g., one or more side brushes) configured to urge debris from outside a periphery of the robotic cleaner toward a movement path of the robotic cleaner. For example, one or more side brushes may improve a cleaning performance of the robotic cleaner when traveling adjacent a vertically extending surface (e.g., a wall).

BRIEF DESCRIPTION OF THE DRAWINGS

These and other features advantages will be better understood by reading the following detailed description, taken together with the drawings wherein.

DETAILED DESCRIPTION

The present disclosure is generally directed to a robotic cleaner. The robotic cleaner may include one or more driven wheels configured to urge the robotic cleaner along a surface to be cleaned (e.g., a floor), one or more sensors configured to detect a feature of an environment, and an air jet assembly configured to generate an air jet. The air jet assembly can be caused to selectively generate an air jet based, at least in part, on outputs generated by the one or more sensors. For example, the air jet assembly can be caused to generate the air jet in response to the one or more sensors indicating a presence of a vertically extending surface (e.g., a wall). By way of further example, the air jet assembly can be caused to selectively generate the air jet as the robotic cleaner traverses an intersection of vertically extending surfaces (e.g., a corner formed at an intersection of two walls). In some instances, the robotic cleaner may further include a side brush, wherein an operational state of the side brush corresponds to an operational state of the air jet assembly. For example, the operational state of the side brush may correspond to an operational state of the air jet assembly during a wall-following and/or corner traversal behavior.

Figure 1:
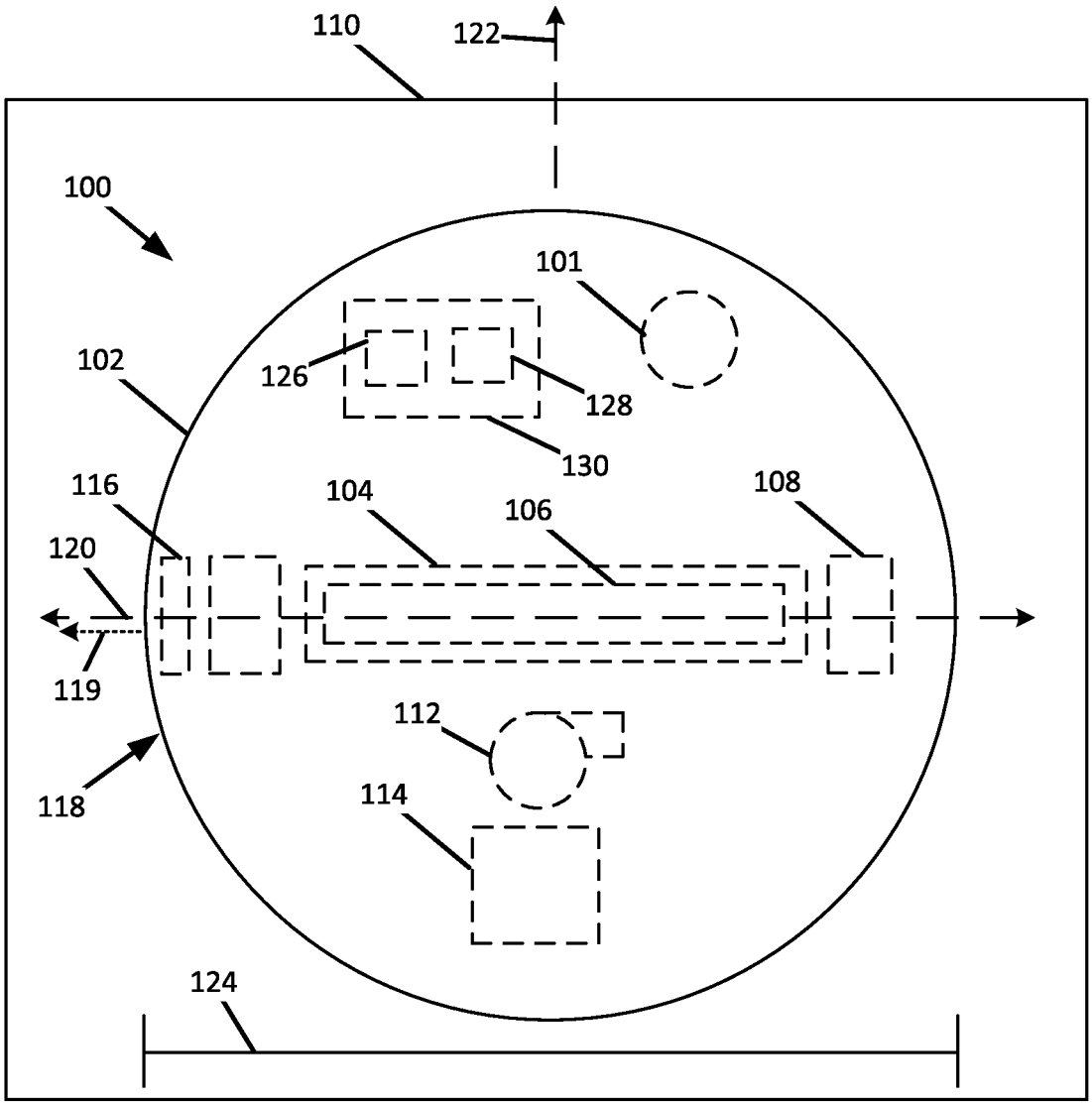
FIG. 1 is a schematic top view of an example of a robotic cleaner, consistent with embodiments of the present disclosure.

FIG. 1 shows a schematic example of a robotic cleaner 100. As shown, the robotic cleaner 100 includes a body 102 having an agitator chamber 104 (shown in hidden lines) that is configured to receive one or more agitators 106 (shown in hidden lines) and one or more driven wheels 108 (shown in hidden lines) configured to urge the robotic cleaner 100 across a surface to be cleaned 110 (e.g., a floor). In some instances, the robotic cleaner 100 may include a side brush 101 (shown in hidden lines) configured to rotate about a rotation axis that extends transverse to (e.g., perpendicular to) the surface to be cleaned 110. A suction motor 112 (shown in hidden lines) is fluidly coupled to the agitator chamber 104 and configured to urge air to flow into the agitator chamber 104. A dust cup 114 (shown in hidden lines) may be fluidly coupled to the suction motor 112 and the agitator chamber 104 such that at least a portion of debris entrained within air flowing into the agitator chamber 104 is deposited in the dust cup 114. In other words, the suction motor 112 is fluidly coupled to the agitator chamber 104 and the dust cup 114. An exhaust side of the suction motor 112 can be fluidly coupled to one or more air jet assemblies 116. Additionally, or alternatively, a fan assembly may be included in the robotic cleaner 100, wherein the fan assembly may be fluidly coupled to the one or more air jet assemblies 116 to generate an air jet. At least one of the one or more air jet assemblies 116 and at least one of the one or more side brushes 101 may be disposed on a common side (or on opposing sides) of the robotic cleaner 100.

Figure 2:
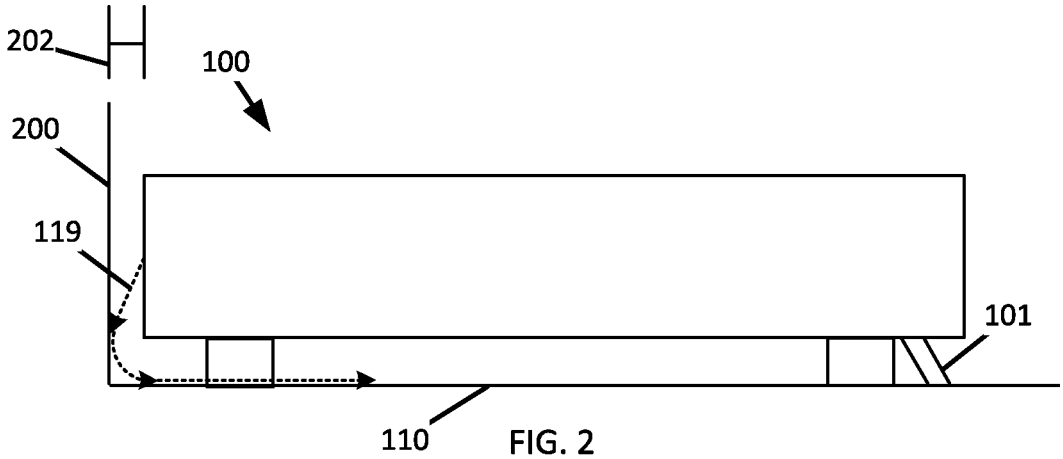
FIG. 2 is a schematic side view of an example of the robotic cleaner of FIG. 1, consistent with embodiments of the present disclosure.

As shown, at least a portion of the one or more air jet assemblies 116 can be disposed along a peripheral edge 118 of the body 102. The one or more air jet assemblies 116 can be positioned along the peripheral edge 118 such that an air jet 119 generated by the air jet assembly 116 extends in a direction outwardly from the body 102 (e.g., radially outwardly when the body 102 has a generally circular cross-section). Additionally, or alternatively, the one or more air jet assemblies 116 can be configured such that the air jet 119 generated by the air jet assembly 116 extends in a downward direction toward the surface to be cleaned 110. For example, the air jet 119 generated by the one or more air jet assemblies 116 may extend outwardly from the body 102 and in a direction of the surface to be cleaned 110. In this example, and as shown in FIG. 2, when the robotic cleaner 100 travels along a vertical surface 200 (e.g., a wall) extending from the surface to be cleaned 110, the air jet 119 may intersect with the vertical surface 200 before intersecting the surface to be cleaned 110. Such a configuration may result in the formation of a vortex between the body 102, the vertical surface 200, and the surface to be cleaned 110, which may improve debris agitation. Additionally, or alternatively, the one or more air jet assemblies 116 can be configured such that the air jet 119 extends forwardly (relative to a forward direction of movement of the robotic cleaner 100).

The one or more air jet assemblies 116 may be positioned along the peripheral edge 118 at a location that minimizes a separation distance 202 between the one or more air jet assemblies 116 and the vertical surface 200 when the robotic cleaner 100 is traveling along the vertical surface 200. For example, the one or more air jet assemblies 116 may be disposed along an assembly axis 120. The assembly axis 120 extends transverse to (e.g., perpendicular to) a forward direction of movement 122 of the robotic cleaner 100 and extends along a widest width 124 of the body 102, the widest width 124 extends in a direction transverse to (e.g., perpendicular to) the forward direction of movement 122. In some instances, the one or more air jet assemblies 116 may be positioned forward and/or rearward of the widest width 124. In some instances, the separation distance 202 may be, for example, in a range of 0.5 centimeter (cm) to 1.5 cm. By way of further example, the separation distance 202 may be about (e.g., within 1%, 2%, 3%, 4%, or 5% of) 1 cm.

Figure 3:
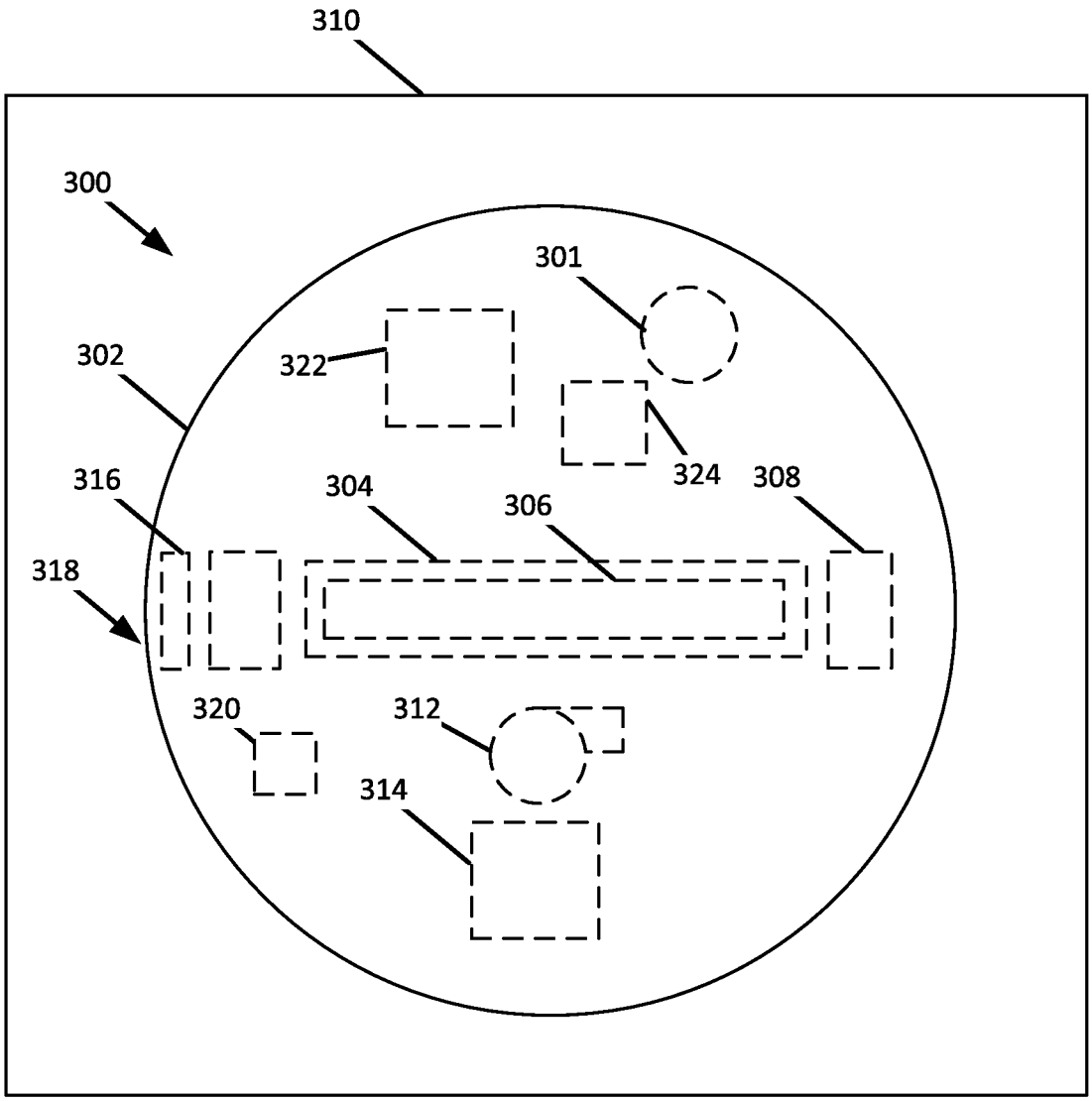
FIG. 3 is a schematic top view of an example of a robotic cleaner, consistent with embodiments of the present disclosure.

FIG. 3 shows a schematic example of a robotic cleaner 300, which is an example of the robotic cleaner 100 of FIG. 1. As shown, the robotic cleaner 300 includes a body 302 having an agitator chamber 304 (shown in hidden lines) that is configured to receive one or more agitators 306 (shown in hidden lines) and one or more driven wheels 308 (shown in hidden lines) configured to urge the robotic cleaner 300 across a surface to be cleaned 310 (e.g., a floor). In some instances, the robotic cleaner 300 may include a side brush 301 (shown in hidden lines) configured to rotate about a rotation axis that extends transverse to (e.g., perpendicular to) the surface to be cleaned 310. A suction motor 312 (shown in hidden lines) is fluidly coupled to the agitator chamber 304 and configured to urge air to flow into the agitator chamber 304. A dust cup 314 (shown in hidden lines) may be fluidly coupled to the suction motor 312 and the agitator chamber 304 such that at least a portion of debris entrained within air flowing into the agitator chamber 304 is deposited in the dust cup 314. One or more air jet assemblies 316 (shown in hidden lines) may be disposed at a peripheral edge 318 of the body 302 of the robotic cleaner 300.

The one or more air jet assemblies 316 are fluidly coupled to a fan 320 (shown in hidden lines). The fan 320 is configured to cause air to flow through the one or more air jet assemblies 316, forming an air jet. The fan 320 may be communicatively coupled to a controller 322 (shown in hidden lines) of the robotic cleaner 300. The controller 322 may be configured to adjust an operation of the fan 320. For example, the controller 322 may adjust the operation of the fan 320 based, at least in part, on outputs generated by one or more sensors 324 (shown in hidden lines) configured to detect one or more features within an environment (e.g., proximity of a vertical surface such as a wall and/or a quantity and/or size of debris adjacent a vertical surface).

Adjusting operation of the fan 320 may include enabling and disabling the fan 320, changing the fan speed, and/or any other operational adjustment. For example, the controller 322 may be configured to enable the fan 320 in response to at least one of the one or more sensors 324 detecting the presence of a vertical surface (e.g., a wall) and to disable the fan 320 in response to the one or more sensors 324 not detecting the vertical surface. As such, an air jet may be generated when the robotic cleaner 300 detects (e.g., is following) a vertically extending surface but not when traversing a central portion of an area and/or a virtual barrier (e.g., virtual wall), potentially reducing power consumption. By way of further example, the controller 322 may cause the fan 320 to operate at higher speeds with increasing distance from a vertical surface and/or based on a quantity of detected debris adjacent the vertical surface (e.g., when the one or more sensors 324 includes a debris detection sensor). By way of still further example, a user of the robotic cleaner 300 may adjust the operation of the fan 320 manually (e.g., using an interface on the robotic cleaner 300 and/or through an application on a computing device such as a mobile phone or tablet). In this example, a user may select between a plurality of different fan speeds (e.g., at least 3 fan speeds) such as, for example, a high, medium, and low fan speed. Additionally, or alternatively, the user may select an automatic fan speed. The automatic fan speed may be determined by the controller 322 of the robotic cleaner 300 using, for example, the one or more sensors 324. The user may also cause the fan 320 to be disabled. In some instances, the user may indicate areas (e.g., rooms and/or regions within rooms) in which the fan 320 is to be disabled (e.g., using a map of the environment displayed on a device such as a mobile phone).

Figure 4:
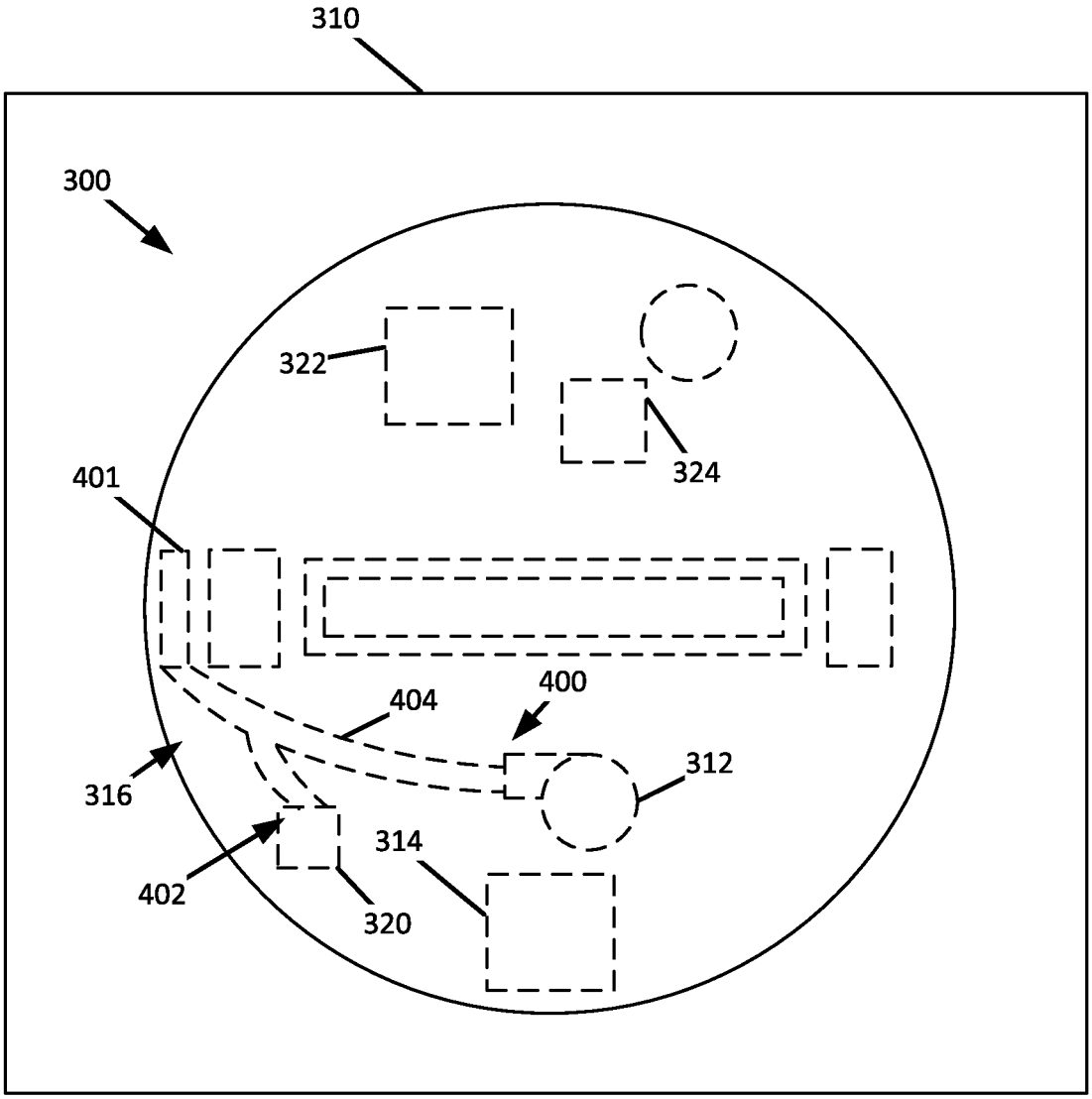
FIG. 4 is a schematic top view of an example of a robotic cleaner, consistent with embodiments of the present disclosure.

FIG. 4 shows a schematic example of the robotic cleaner 300, wherein the fan 320 and suction motor 312 cooperate to urge air into the one or more air jet assemblies 316. As shown, a suction motor exhaust 400 of the suction motor 312 and a fan exhaust 402 of the fan 320 is fluidly coupled to a duct 404 (shown in hidden lines) of at least one of the one or more air jet assemblies 316. The duct 404 fluidly couples the suction motor 312 and fan 320 to a nozzle 401 of at least one of the one or more air jet assemblies 316. The duct 404 may, in some instances, be at least partially (e.g., entirely) formed from a body of the robotic cleaner 300. Alternatively, the duct 404 may be a separate component that couples to a body of the robotic cleaner 300.

In operation, the controller 322 may be configured to selectively enable/disable to the fan 320 to adjust a velocity of the generated air jet. When the fan 320 is disabled, a baseline air jet may be generated using only the exhaust of the suction motor 312. In some instances, the baseline air jet may be disabled by fluidly decoupling the suction motor 312 from the nozzle 401 (e.g., using one or more valves). When the fan 320 is enabled, the suction motor 312 and the fan 320 may cooperate to form an augmented air jet, the augmented air jet may have a velocity that is greater than that of the baseline air jet. The velocity of the augmented air jet may be adjusted by adjusting a speed of the fan 320. For example, the controller 322 may adjust a fan speed based, at least in part, on a user input and/or using the one or more sensors 324. The fan 320 may be generally described as having a plurality of non-zero speeds (e.g., at least three non-zero fan speeds). In some instances, the fan speed may be varied (e.g., continuously) such that a pulsed air jet is formed.

Figure 5:
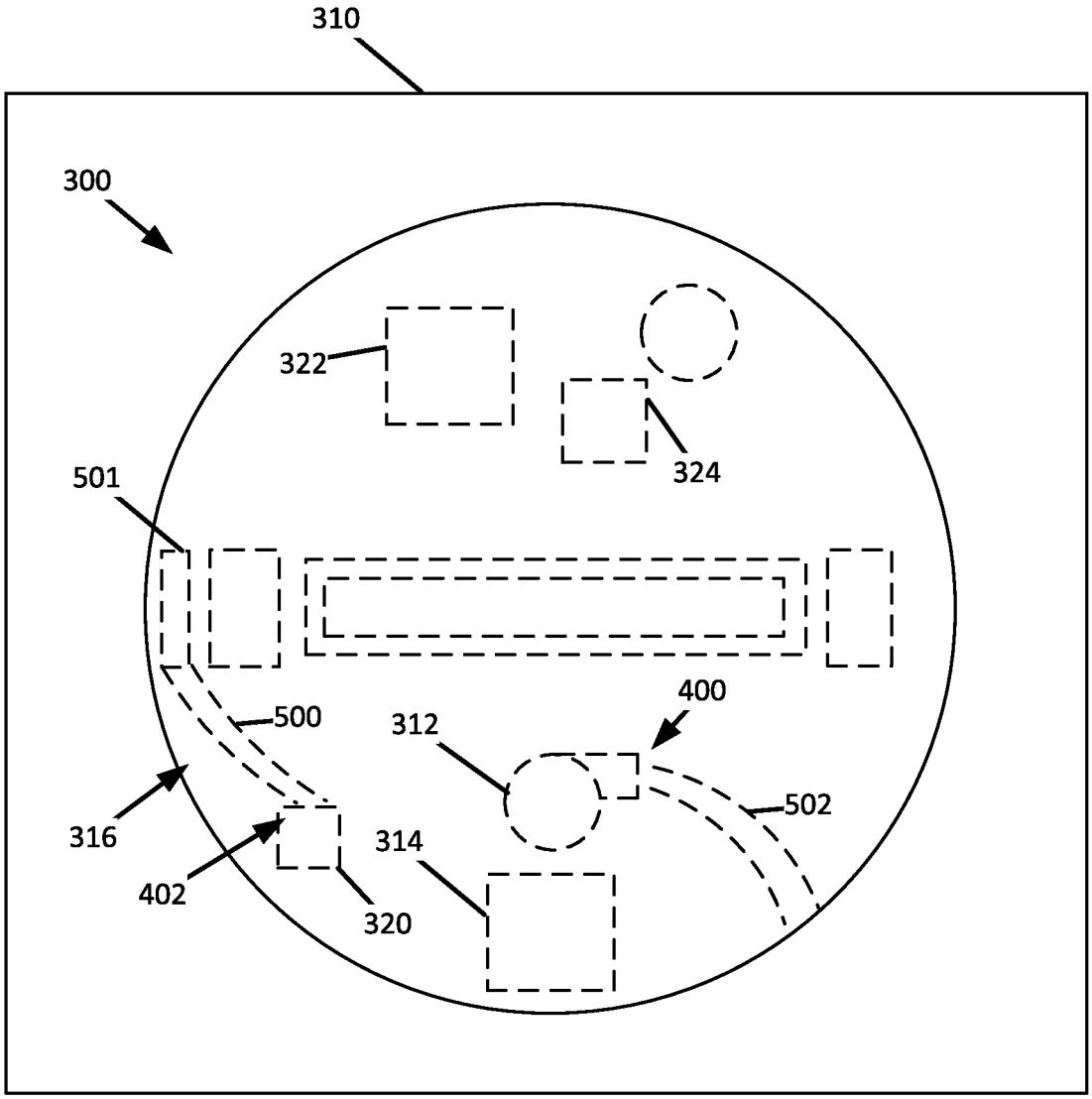
FIG. 5 is a schematic top view of an example of a robotic cleaner, consistent with embodiments of the present disclosure.

FIG. 5 shows a schematic example of the robotic cleaner 300, wherein the fan 320 and suction motor 312 do not cooperate to urge air into the one or more air jet assemblies 316. As shown, a first duct 500 of the air jet assembly 316 fluidly couples the fan exhaust 402 of the fan 320 to at least one nozzle 501 of at least one of the one or more air jet assemblies 316 and a second duct 502 fluidly couples the suction motor exhaust 400 to an exhaust port and/or another nozzle 501 of another one of the one or more air jet assemblies 316. Such a configuration may allow at least one of the one or more air jet assemblies 316 to be positioned without considering proximity of the air jet assembly 316 to the suction motor 312. The ducts 500 and/or 502 may, in some instances, be at least partially (e.g., entirely) formed from a body of the robotic cleaner 300. Alternatively, one or more of the ducts 500 and/or 502 may be a separate component that couples to a body of the robotic cleaner 300.

In operation, the controller 322 may be configured to selectively enable/disable the fan 320 and/or to adjust a fan speed of the fan 320 in order to adjust a velocity of the generated air jet. When the fan 320 is disabled, the air jet assembly 316 fluidly coupled to the fan 320 does not generate an air jet. When the fan 320 is enabled, air is caused to flow through the air jet assembly 316 fluidly coupled to the fan 320. A speed of the fan 320 may be adjusted to adjust a velocity of the generated air jet. The fan 320 may be generally described as having a plurality of non-zero fan speeds (e.g., at least three non-zero fan speeds). In some instances, the fan speed may be varied (e.g., continuously) such that a pulsed air jet is formed.

FIGS. 6A-6E show a schematic example of a robotic cleaner 600 carrying out a method of following a vertically extending surface 602 (e.g., a wall) having a discontinuity 604. One or more steps of the method shown in FIGS. 6A-6E may be embodied as one or more instructions stored in one or more memories 126 of FIG. 1 (e.g., one or more non-transitory memories), wherein the one or more instructions are configured to be executed on one or more processors 128 of FIG. 1. For example, a controller 130 of FIG. 1 may be configured to cause one or more steps of the method to be carried out. Additionally, or alternatively, one or more steps of the method may be carried out in any combination of software, firmware, or circuitry (e.g., an application-specific integrated circuit).

The robotic cleaner 600 is an example of the robotic cleaner 100 of FIG. 1. The discontinuity 604 may be a gap between two adjacent vertical surfaces (e.g., a doorway), a recessed region where the robotic cleaner cannot traverse (e.g., a toe kick of a cabinet or the space between a piece of furniture and a floor), a drop off, and/or any other type of discontinuity. In some instances, the robotic cleaner 600 may include one or more side brushes (e.g., the side brush 101 of FIG. 1). At least one side brush may be on the same side of the robotic cleaner 600 as the air jet assembly configured to generate an air jet 606. At least one side brush may be configured to be enabled when the air jet assembly is generating the air jet 606 and disabled when the air jet assembly is not generating the air jet 606. In other words, an operational state of at least one side brush (e.g., on or off) may correspond to an operational state of the air jet assembly (e.g., air jet being generated or air jet not being generated).

Figures 6A, 6B, 6C, 6D, 6E:
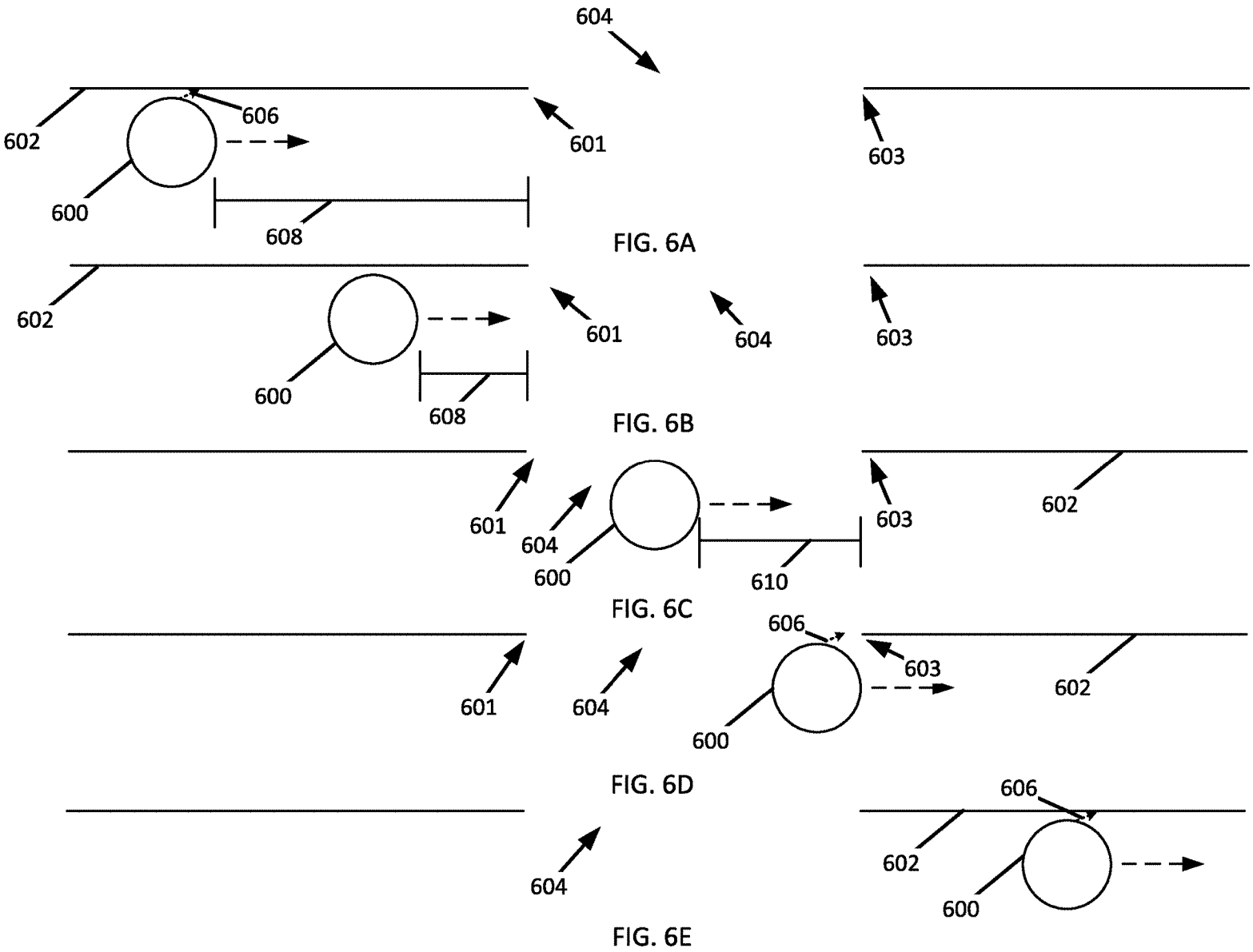
FIG. 6A is a schematic example of a robotic cleaner traversing a vertically extending surface having a discontinuity, consistent with embodiments of the present disclosure.
FIG. 6B is a schematic example of the robotic cleaner of FIG. 6A traversing the vertically extending surface at a different point in time, consistent with embodiments of the present disclosure.
FIG. 6C is a schematic example of the robotic cleaner of FIG. 6A traversing the vertically extending surface at a different point in time, consistent with embodiments of the present disclosure.
FIG. 6D is a schematic example of the robotic cleaner of FIG. 6A traversing the vertically extending surface at a different point in time, consistent with embodiments of the present disclosure.
FIG. 6E is a schematic example of the robotic cleaner of FIG. 6A traversing the vertically extending surface at a different point in time, consistent with embodiments of the present disclosure.

With reference to FIG. 6A, the robotic cleaner 600 is configured to generate the air jet 606 when following the vertically extending surface 602. When following the vertically extending surface 602, the robotic cleaner 600 may be configured to determine an approach separation distance 608 that extends between the robotic cleaner 600 (e.g., a forward most portion) and a first side 601 of the discontinuity 604. The robotic cleaner 600 may be configured to determine the approach separation distance 608 using a map of the environment. Additionally, or alternatively, the robotic cleaner 600 may have one or more sensors configured to detect the first side 601 of the discontinuity 604. When the approach separation distance 608 is greater than an approach threshold, the robotic cleaner 600 is configured to generate the air jet 606.

With reference to FIG. 6B, when the approach separation distance 608 is less than or equal to the approach threshold, the robotic cleaner 600 discontinues generating the air jet 606. Discontinuing generation of the air jet 606 may reduce or prevent debris from being urged into the discontinuity 604 of the vertically extending surface 602. As such, the approach threshold may be based, at least in part, on the average distance debris is moved by the air jet 606. For example, the approach threshold may be in a range of 5 millimeters (mm) to 30 mm. By way of further example, the approach threshold may be in a range of 8 mm to 22 mm. By way of still further example, the approach threshold may be about (e.g., within 1%, 2%, 3%, 4%, or 5% of) 10 mm or about 20 mm. By way of still further example, the approach threshold may be in a range of 2% of the widest width of the robotic cleaner 600 to 10% of the widest width of the robotic cleaner 600.

With reference to FIG. 6C, as the robotic cleaner 600 travels across the discontinuity 604, the robotic cleaner 600 is configured to determine a departure separation distance 610. The departure separation distance 610 extends from the robotic cleaner 600 (e.g., a forward most portion) to a second side 603 of the discontinuity 604, the second side 603 of the discontinuity 604 being opposite the first side 601 of the discontinuity 604. The robotic cleaner 600 may be configured to determine the departure separation distance 610 using a map of the environment. Additionally, or alternatively, the robotic cleaner 600 may have one or more sensors configured to detect the second side 603 of the discontinuity 604, wherein the departure separation distance 610 may be determined using the one or more sensors. Generation of the air jet 606 may remain disabled until the departure separation distance 610 is less than or equal to a departure threshold.

With reference to FIG. 6D, when the departure separation distance 610 is less than or equal to the departure threshold, the robotic cleaner 600 resumes generating the air jet 606. Resuming generation of the air jet 606, when at least a portion of the robotic cleaner 600 is still traversing the discontinuity 604, may allow debris proximate the second side 603 of the discontinuity to be urged into a movement path of the robotic cleaner 600. As such, the departure threshold may be based, at least in part, on the average distance debris is moved by the air jet 606 and/or a time for the air jet 606 to reach a desired velocity. For example, the departure threshold may be in a range of 1 mm to 10 mm. By way of further example, the departure threshold may be in a range of 40 mm to 60 mm. By way of still further example, the departure threshold may be about 5 mm or about 50 mm. By way of still further example, the departure threshold may be in a range of 1% of the widest width of the robotic cleaner 600 to 20% of the widest width of the robotic cleaner 600.

With reference to FIG. 6E, after traversing the discontinuity 604, the robotic cleaner 600 may resuming traversing the vertically extending surface 602 while generating the air jet 606.

FIGS. 7A-7G show a schematic example of a robotic cleaner 700 carrying out a method cleaning an intersection of two vertically extending surfaces (e.g., a corner region formed at an intersection of two walls). One or more steps of the method shown in FIGS. 7A-7G may be embodied as one or more instructions stored in one or more memories 126 of FIG. 1 (e.g., one or more non-transitory memories), wherein the one or more instructions are configured to be executed on one or more processors of FIG. 1. For example, a controller 130 of FIG. 1 may be configured to cause one or more steps of the method to be carried out. Additionally, or alternatively, one or more steps of the method may be carried out in any combination of software, firmware, or circuitry (e.g., an application-specific integrated circuit).

The robotic cleaner 700 is an example of the robotic cleaner 100 and may include an air jet assembly 702 (shown in hidden lines) configured to selectively generate an air jet 704. As shown, the robotic cleaner 700 may be configured to follow a first vertically extending surface 706 that intersects with a second vertically extending surface 708 (e.g., at a perpendicular or non-perpendicular angle). The intersection of the first and second vertically extending surfaces 706 and 708 may be generally referred to as a corner region 710. In some instances, the robotic cleaner 700 may include one or more side brushes (e.g., the side brush 101 of FIG. 1). At least one side brush may be on the same side of the robotic cleaner 700 as the air jet assembly 702. At least one side brush may be configured to be enabled when the air jet assembly 702 is generating the air jet 704 and disabled when the air jet assembly 702 is not generating the air jet 704. In other words, an operational state of at least one side brush (e.g., on or off) may correspond to an operational state of the air jet assembly 702 (e.g., air jet being generated or air jet not being generated).

Figure 7A:
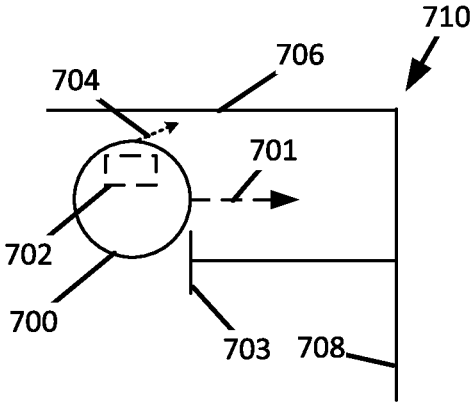
FIG. 7A is a schematic example of a robotic cleaner configured to traverse a corner region, consistent with embodiments of the present disclosure.

With reference to FIG. 7A, the robotic cleaner 700 is configured to follow the first vertically extending surface 706, while generating the air jet 704. As shown, while following the first vertically extending surface 706 according to a forward direction of movement 701, the robotic cleaner 700 approaches the second vertically extending surface 708, decreasing a second surface separation distance 703 that extends between the robotic cleaner 700 (e.g., a forward most portion) and the second vertically extending surface 708.

Figure 7B:
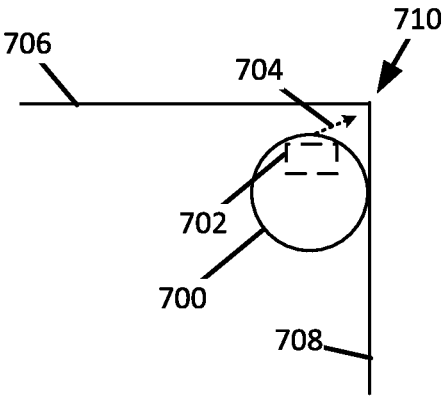
FIG. 7B is a schematic example of the robotic cleaner of FIG. 7A at a different point in time, consistent with embodiments of the present disclosure.

With reference to FIG. 7B, the robotic cleaner 700 is configured to discontinue moving in the forward direction of movement 701 in response to the second surface separation distance 703 being less than or equal to a second surface threshold. For example, the robotic cleaner 700 may include a displaceable bumper that is configured to move, actuating one or more sensors, in response to the displaceable bumper engaging (e.g., contacting) the second vertically extending surface 708. In response to the displaceable bumper being displaced, the robotic cleaner 700 may be configured to determine that the second surface separation distance 703 is less than or equal to the second surface threshold. Additionally, or alternatively, the robotic cleaner 700 may include one or more distance sensors configured to measure a distance to the second vertically extending surface 708. When the robotic cleaner 700 includes one or more distance sensors, the robotic cleaner 700 may not contact the second vertically extending surface 708.

Figure 7C:
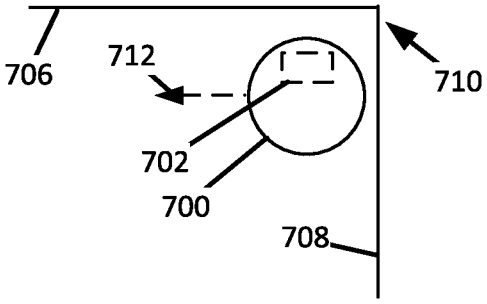
FIG. 7C is a schematic example of the robotic cleaner of FIG. 7A at a different point in time, consistent with embodiments of the present disclosure.

With reference to FIG. 7C, when the second surface separation distance 703 is less than or equal to the second surface threshold, the robotic cleaner 700 is configured to disable generation of the air jet 704. In some instances, the robotic cleaner 700 may be further configured to move in a rearward direction of movement 712 for a predetermined rearward movement distance. For example, the robotic cleaner 700 may be caused to move in the rearward direction of movement 712 when the second surface separation distance 703 is insufficient to enable the robotic cleaner 700 to rotate without the robotic cleaner 700 engaging the second vertically extending surface 708. Such a configuration may prevent or mitigate a risk of the robotic cleaner 700 damaging the second vertically extending surface 708.

Figure 7D:
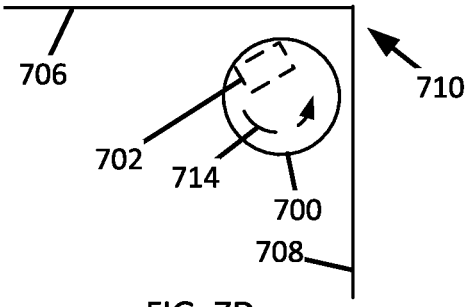
FIG. 7D is a schematic example of the robotic cleaner of FIG. 7A at a different point in time, consistent with embodiments of the present disclosure.

With reference to FIG. 7D, while generation of the air jet 704 is discontinued, the robotic cleaner 700 may be caused to rotate in a first rotation direction 714. Rotation in the first rotation direction 714 is configured to cause the forward direction of movement 701 to initially move towards the corner region 710. For example, the robotic cleaner 700 may be caused to rotate in the first rotation direction 714 until the forward direction of movement 701 intersects the corner region 710. By way of further example, the robotic cleaner 700 may be caused to rotate in the first rotation direction 714 such that the forward direction of movement 701 intersects the first vertically extending surface 706. By way of still further example, the robotic cleaner 700 may rotate in the first rotation direction 714 for a rotation angle of about (e.g., within 1%, 2%, 3%, 4%, or 5% of) 30°.

Figure 7E:
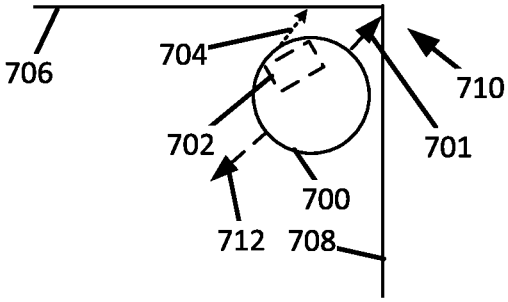
FIG. 7E is a schematic example of the robotic cleaner of FIG. 7A at a different point in time, consistent with embodiments of the present disclosure.

With reference to FIG. 7E, in response to completing rotation in the first rotation direction 714, the robotic cleaner 700 may be caused to generate the air jet 704 and to move in the forward direction of movement 701. For example, the robotic cleaner 700 may be caused to move in the forward direction of movement 701 until the robotic cleaner 700 engages with the first and the second vertically extending surfaces 706 and 708. In response to engaging with the first and second vertically extending surfaces 706 and 708, the robotic cleaner 700 may be caused to move in the rearward direction of movement 712 until the robotic cleaner 700 comes out of engagement with the first and second vertically extending surfaces 706 and 708.

Figure 7F:
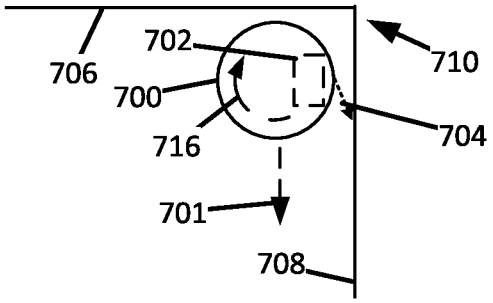
FIG. 7F is a schematic example of the robotic cleaner of FIG. 7A at a different point in time, consistent with embodiments of the present disclosure.

With reference to FIG. 7F, in response to the robotic cleaner 700 coming out of engagement with the first and second vertically extending surfaces 706 and 708, the robotic cleaner 700 is caused to rotate in a second rotation direction 716 while generating the air jet 704, the second rotation direction 716 being opposite the first rotation direction 714. For example, the robotic cleaner 700 may rotate in the second rotation direction 716 until the forward direction of movement 701 is substantially parallel with the second vertically extending surface 708.

Figure 7G:
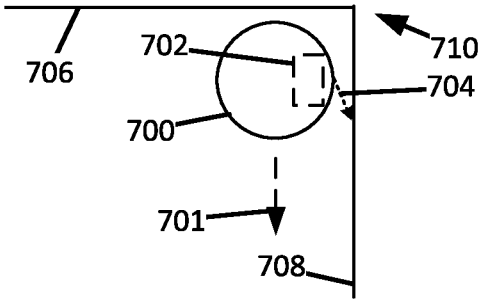
FIG. 7G is a schematic example of the robotic cleaner of FIG. 7A at a different point in time, consistent with embodiments of the present disclosure.

With reference to FIG. 7G, after rotating in the second rotation direction 716, the robotic cleaner 700 is caused to follow the second vertically extending surface 708 while generating the air jet 704.

FIGS. 8A-8H show a schematic example of a robotic cleaner 800 carrying out a method cleaning an intersection of two vertically extending surfaces (e.g., a corner region formed at an intersection of two walls). One or more steps of the method shown in FIGS. 8A-8H may be embodied as one or more instructions stored in one or more memories 126 of FIG. 1 (e.g., one or more non-transitory memories), wherein the one or more instructions are configured to be executed on one or more processors 128 of FIG. 1. For example, the controller 130 of FIG. 1 may be configured to cause one or more steps of the method to be carried out. Additionally, or alternatively, one or more steps of the method may be carried out in any combination of software, firmware, or circuitry (e.g., an application-specific integrated circuit).

The robotic cleaner 800 is an example of the robotic cleaner 100 and may include an air jet assembly 802 (shown in hidden lines) configured to selectively generate an air jet 804. As shown, the robotic cleaner 800 may be configured to follow a first vertically extending surface 806 that intersects with a second vertically extending surface 808 (e.g., at a perpendicular or non-perpendicular angle). The intersection of the first and second vertically extending surfaces 806 and 808 may be generally referred to as a corner region 810. In some instances, the robotic cleaner 800 may include one or more side brushes (e.g., the side brush 101 of FIG. 1). At least one side brush may be on the same side of the robotic cleaner 800 as the air jet assembly 802. At least one side brush may be configured to be enabled when the air jet assembly 802 is generating the air jet 804 and disabled when the air jet assembly 802 is not generating the air jet 804. In other words, an operational state of at least one side brush (e.g., on or off) may correspond to an operational state of the air jet assembly 802 (e.g., air jet being generated or air jet not being generated).

Figure 8A:
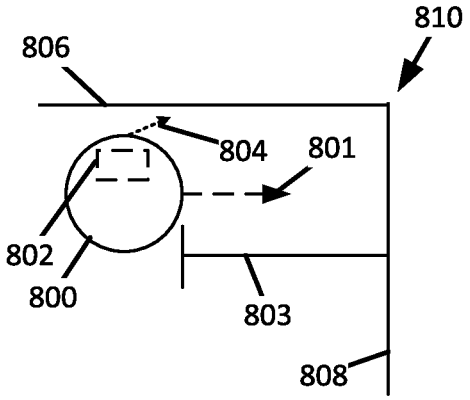
FIG. 8A is a schematic example of a robotic cleaner configured to traverse a corner region, consistent with embodiments of the present disclosure.

With reference to FIG. 8A, the robotic cleaner 800 is configured to follow the first vertically extending surface 806 while generating the air jet 804. As shown, while following the first vertically extending surface 806 according to a forward direction of movement 801, the robotic cleaner 800 approaches the second vertically extending surface 808, decreasing a second surface separation distance 803 that extends between the robotic cleaner 800 (e.g., a forward most portion) and the second vertically extending surface 808.

Figure 8B:
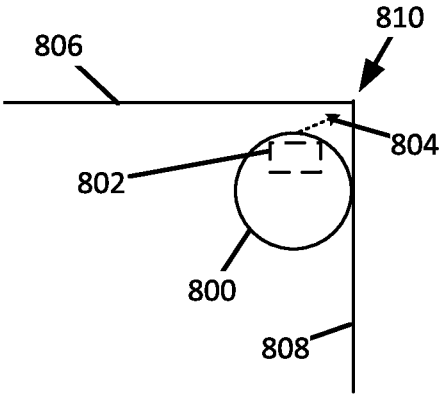
FIG. 8B is a schematic example of the robotic cleaner of FIG. 8A at a different point in time, consistent with embodiments of the present disclosure.

With reference to FIG. 8B, the robotic cleaner 800 is configured, while generating the air jet 804, to discontinue moving in the forward direction of movement 801 in response to the second surface separation distance 803 being less than or equal to a second surface threshold. For example, the robotic cleaner 800 may include a displaceable bumper that is configured to move, actuating one or more sensors, in response to the displaceable bumper engaging (e.g., contacting) the second vertically extending surface 808. In response to the displaceable bumper being displaced, the robotic cleaner 800 may be configured to determine that the second surface separation distance 803 is less than or equal to the second surface threshold. Additionally, or alternatively, the robotic cleaner 800 may include one or more distance sensors configured to measure a distance to the second vertically extending surface 808. When the robotic cleaner 800 includes one or more distance sensors, the robotic cleaner 800 may not contact the second vertically extending surface 808.

Figure 8C:
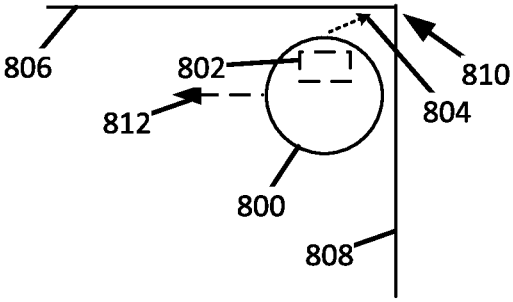
FIG. 8C is a schematic example of the robotic cleaner of FIG. 8A at a different point in time, consistent with embodiments of the present disclosure.

With reference to FIG. 8C, the robotic cleaner 800 may be caused to move in a rearward direction of movement 812 for a predetermined rearward movement distance while generating the air jet 804. For example, the robotic cleaner 800 may be caused to move in the rearward direction of movement 812 when the second surface separation distance 803 is insufficient to enable to robotic cleaner 800 to rotate without the robotic cleaner 800 engaging the second vertically extending surface 808. Such a configuration may prevent or mitigate a risk of the robotic cleaner 800 damaging the second vertically extending surface 808.

Figure 8D:
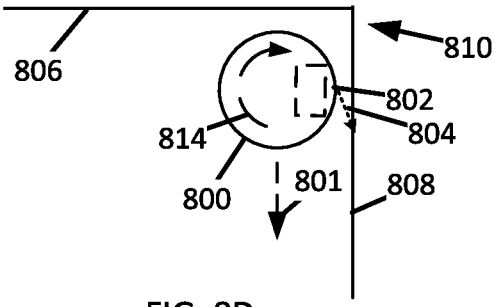
FIG. 8D is a schematic example of the robotic cleaner of FIG. 8A at a different point in time, consistent with embodiments of the present disclosure.

With reference to FIG. 8D, the robotic cleaner 800 is caused to rotate in a first rotation direction 814 such that the air jet 804 moves along the second vertically extending surface 808 and the forward direction of movement 801 moves away from the corner region 810. For example, the robotic cleaner 800 may be configured to rotate in the first rotation direction 814 such that the forward direction of movement 801 moves away from the first vertically extending surface 806 until the forward direction of movement 801 extends substantially parallel to the second vertically extending surface 808. By way of further example, the robotic cleaner 800 may be configured to rotate in the first rotation direction 814 for a rotation angle of about 90°.

Figure 8E:
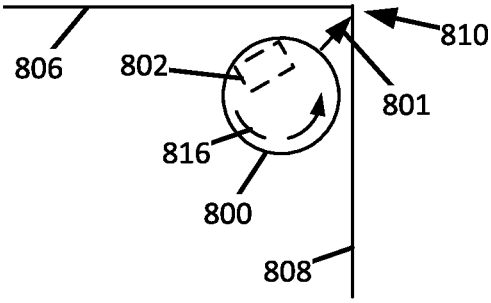
FIG. 8E is a schematic example of the robotic cleaner of FIG. 8A at a different point in time, consistent with embodiments of the present disclosure.

With reference to FIG. 8E, in response to completing rotation in the first rotation direction 814, the robotic cleaner 800 may disable generation of the air jet 804 and rotate in a second rotation direction 816, the second rotation direction 816 being opposite the first rotation direction 814. Rotating in the second rotation direction 816 is configured to cause the forward direction of movement 801 to move towards the corner region 810. For example, the robotic cleaner 800 may be caused to rotate in the second rotation direction 816 until the forward direction of movement 801 intersects the corner region 810. By way of further example, the robotic cleaner 800 may be caused to rotate in the second rotation direction 816 such that the forward direction of movement 801 intersects the first vertically extending surface 806. By way of still further example, the robotic cleaner 800 may rotate in the second rotation direction 816 for a rotation angle of about 120°.

Figure 8F:
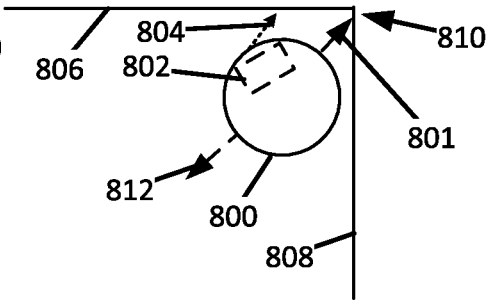
FIG. 8F is a schematic example of the robotic cleaner of FIG. 8A at a different point in time, consistent with embodiments of the present disclosure.

With reference to FIG. 8F, after completing rotation in the second rotation direction, the robotic cleaner 800 may be caused to move in the forward direction of movement 801 until the robotic cleaner 800 engages the first and second vertically extending surface 806 and 808 while generating the air jet 804. In response to the robotic cleaner 800 engaging the first and second vertically extending surfaces 806 and 808, the robotic cleaner 800 may be caused to move in the rearward direction of movement 812. The robotic cleaner 800 may be caused to move in the rearward direction of movement 812 until the robotic cleaner 800 comes out of engagement with the first and second vertically extending surfaces 806 and 808.

Figure 8G:
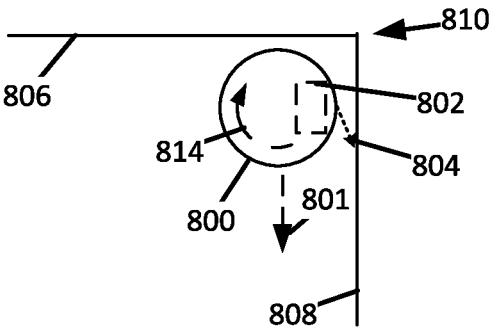
FIG. 8G is a schematic example of the robotic cleaner of FIG. 8A at a different point in time, consistent with embodiments of the present disclosure.

With reference to FIG. 8G, in response to the robotic cleaner 800 coming out of engagement with the first and second vertically extending surfaces 806 and 808, the robotic cleaner 800 is caused to rotate in the first rotation direction 814 while generating the air jet 804. For example, robotic cleaner 800 may rotate in the first rotation direction 814 until the forward direction of movement 801 is substantially parallel to the second vertically extending surface 808. By way of further example, the robotic cleaner 800 may rotate in the first rotation direction 814 for a rotation angle of about 120°.

Figure 8H:
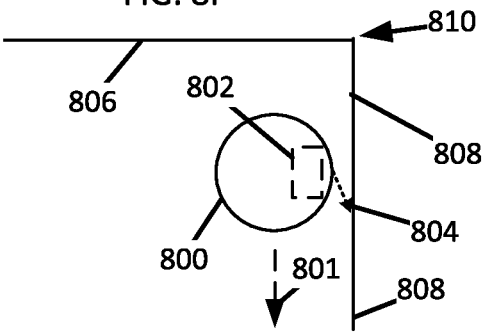
FIG. 8H is a schematic example of the robotic cleaner of FIG. 8A at a different point in time, consistent with embodiments of the present disclosure.

With reference to FIG. 8H, after rotating in the first rotation direction 814 for the second time, the robotic cleaner 800 is caused to follow the second vertically extending surface 808 while generating the air jet 804.

FIGS. 9A-9E show a schematic example of a robotic cleaner 900 carrying out a method cleaning an intersection of two vertically extending surfaces (e.g., a corner region formed at an intersection of two walls). One or more steps of the method shown in FIGS. 9A-9E may be embodied as one or more instructions stored in one or more memories 126 of FIG. 1 (e.g., one or more non-transitory memories), wherein the one or more instructions are configured to be executed on one or more processors 128 of FIG. 1. For example, the controller 130 of FIG. 1 may be configured to cause one or more steps of the method to be carried out. Additionally, or alternatively, one or more steps of the method may be carried out in any combination of software, firmware, or circuitry (e.g., an application-specific integrated circuit).

The robotic cleaner 900 is an example of the robotic cleaner 100 and may include an air jet assembly 902 (shown in hidden lines) configured to selectively generate an air jet 904. As shown, the robotic cleaner 900 may be configured to follow a first vertically extending surface 906 that intersects with a second vertically extending surface 908 (e.g., at a perpendicular or a non-perpendicular angle). The intersection of the first and second vertically extending surfaces 906 and 908 may be generally referred to as a corner region 910. In some instances, the robotic cleaner 900 may include one or more side brushes (e.g., the side brush 101 of FIG. 1). At least one side brush may be on the same side of the robotic cleaner 900 as the air jet assembly 902. At least one side brush may be configured to be enabled when the air jet assembly 902 is generating the air jet 904 and disabled when the air jet assembly 902 is not generating the air jet 904. In other words, an operational state of at least one side brush (e.g., on or off) may correspond to an operational state of the air jet assembly 902 (e.g., air jet being generated or air jet not being generated).

Figure 9A:
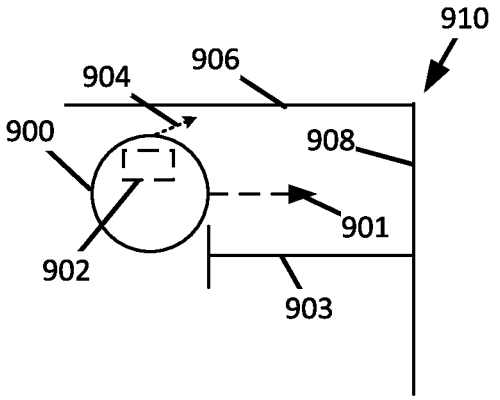
FIG. 9A is a schematic example of a robotic cleaner configured to traverse a corner region, consistent with embodiments of the present disclosure.

With reference to FIG. 9A, the robotic cleaner 900 is configured to follow the first vertically extending surface 906 while generating the air jet 904. As shown, while following the first vertically extending surface 906 according to a forward direction of movement 901, the robotic cleaner 900 approaches the second vertically extending surface 908, decreasing a second surface separation distance 903 that extends between the robotic cleaner 900 (e.g., a forward most portion) and the second vertically extending surface 908.

Figure 9B:
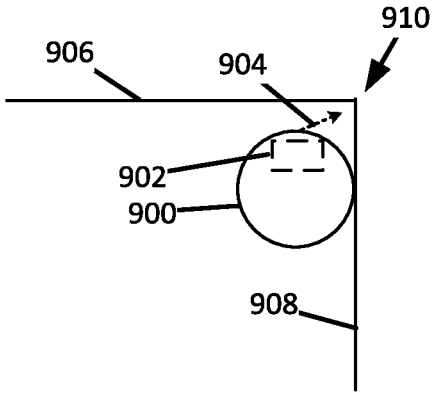
FIG. 9B is a schematic example of the robotic cleaner of FIG. 9A at a different point in time, consistent with embodiments of the present disclosure.

With reference to FIG. 9B, the robotic cleaner 900, while generating the air jet 904, is configured to discontinue moving in the forward direction of movement 901 in response to the second surface separation distance 903 being less than or equal to a second surface threshold. For example, the robotic cleaner 900 may include a displaceable bumper that is configured to move, actuating one or more sensors, in response to the displaceable bumper engaging (e.g., contacting) the second vertically extending surface 908. In response to the displaceable bumper being displaced, the robotic cleaner 900 may be configured to determine that the second surface separation distance 903 is less than or equal to the second surface threshold. Additionally, or alternatively, the robotic cleaner 900 may include one or more distance sensors configured to measure a distance to the second vertically extending surface 908. When the robotic cleaner 900 includes one or more distance sensors, the robotic cleaner 900 may not contact the second vertically extending surface 908.

Figure 9C:
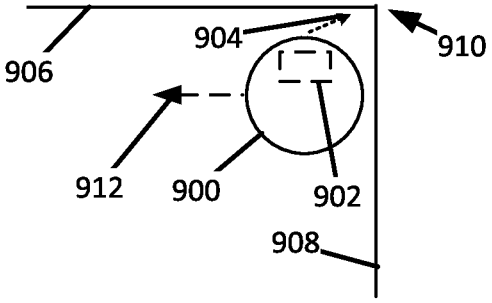
FIG. 9C is a schematic example of the robotic cleaner of FIG. 9A at a different point in time, consistent with embodiments of the present disclosure.

With reference to FIG. 9C, the robotic cleaner 900 may be caused to move in a rearward direction of movement 912 for a predetermined rearward movement distance while generating the air jet 904. For example, the robotic cleaner 900 may be caused to move in the rearward direction of movement 912 when the second surface separation distance 903 is insufficient to enable the robotic cleaner 900 to rotate without the robotic cleaner 900 engaging the second vertically extending surface 908. Such a configuration may prevent or mitigate a risk of the robotic cleaner 900 damaging the second vertically extending surface 908.

Figure 9D:
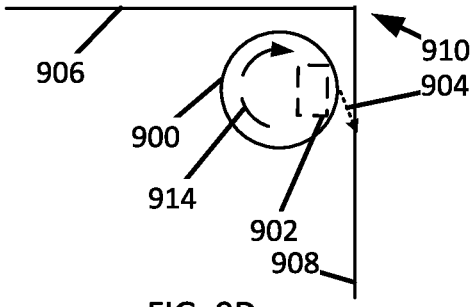
FIG. 9D is a schematic example of the robotic cleaner of FIG. 9A at a different point in time, consistent with embodiments of the present disclosure.

With reference to FIG. 9D, the robotic cleaner 900 is caused to rotate in a first rotation direction 914 while generating the air jet 904. The robotic cleaner 900 rotates in the first rotation direction 914 for at least a complete rotation (e.g., rotates for a rotation angle of at least) 360°. For example, the robotic cleaner 900 may rotate in the first rotation direction 914 for more than a complete rotation such that the forward direction of movement 901 extends substantially parallel to the second vertically extending surface 908. By way of further example, the robotic cleaner 900 may rotate in the first rotation direction 914 for about 450° such that the forward direction of movement 901 extends substantially parallel to the second vertically extending surface 908.

Figure 9E:
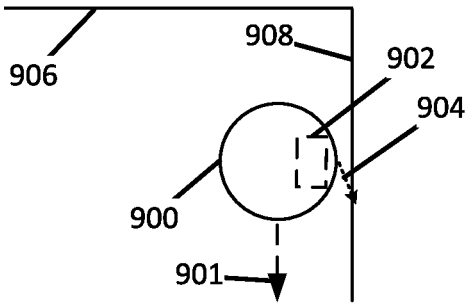
FIG. 9E is a schematic example of the robotic cleaner of FIG. 9A at a different point in time, consistent with embodiments of the present disclosure.

With reference to FIG. 9E, in response to the robotic cleaner 900 completing rotation in the first rotation direction 914, the robotic cleaner 900 may be configured to move according to the forward direction of movement 901 while generating the air jet 904, following the second vertically extending surface 908.

FIGS. 10A-10G show a schematic example of a robotic cleaner 1000 carrying out a method of cleaning an intersection of two vertically extending surfaces (e.g., a corner region formed at an intersection of two walls). One or more steps of the method shown in FIGS. 10A-10G may be embodied as one or more instructions stored in one or more memories 126 of FIG. 1 (e.g., one or more non-transitory memories), wherein the one or more instructions are configured to be executed on one or more processors 128 of FIG. 1. For example, the controller 130 of FIG. 1 may be configured to cause one or more steps of the method to be carried out. Additionally, or alternatively, one or more steps of the method may be carried out in any combination of software, firmware, or circuitry (e.g., an application-specific integrated circuit).

The robotic cleaner 1000 is an example of the robotic cleaner 100 and may include an air jet assembly 1002 (shown in hidden lines) configured to selectively generate an air jet 1004. As shown, the robotic cleaner 1000 may be configured to follow a first vertically extending surface 1006 that intersects with a second vertically extending surface 1008 (e.g., at a perpendicular or non-perpendicular angle). The intersection of the first and second vertically extending surfaces 1006 and 1008 may be generally referred to as a corner region 1010. In some instances, the robotic cleaner 1000 may include one or more side brushes (e.g., the side brush 101 of FIG. 1). At least one side brush may be on the same side of the robotic cleaner 1000 as the air jet assembly 1002. At least one side brush may be configured to be enabled when the air jet assembly 1002 is generating the air jet 1004 and disabled when the air jet assembly 1002 is not generating the air jet 1004. In other words, an operational state of at least one side brush (e.g., on or off) may correspond to an operational state of the air jet assembly 1002 (e.g., air jet being generated or air jet not being generated).

Figure 10A:
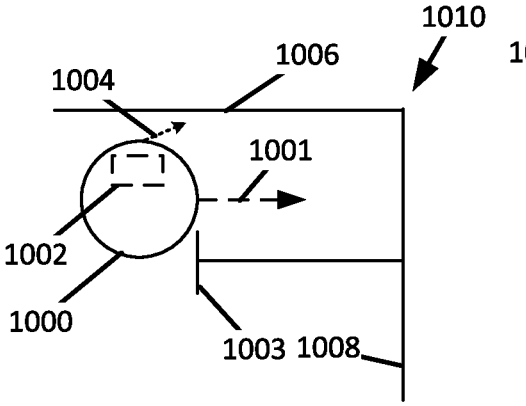
FIG. 10A is a schematic example of a robotic cleaner configured to traverse a corner region, consistent with embodiments of the present disclosure.

With reference to FIG. 10A, the robotic cleaner 1000 is configured to follow the first vertically extending surface 1006 while generating the air jet 1004. As shown, while following the first vertically extending surface 1006 according to a forward direction of movement 1001, the robotic cleaner 1000 approaches the second vertically extending surface 1008, decreasing a second surface separation distance 1003 that extends between the robotic cleaner 1000 (e.g., a forward most portion) and the second vertically extending surface 1008.

Figure 10B:
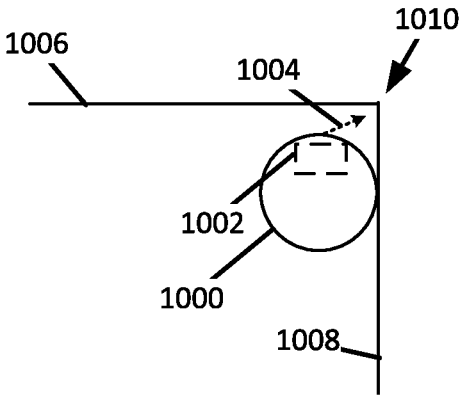
FIG. 10B is a schematic example of the robotic cleaner of FIG. 10A at a different point in time, consistent with embodiments of the present disclosure.

With reference to FIG. 10B, the robotic cleaner 1000, while generating the air jet 1004, is configured to discontinue moving in the forward direction of movement 1001 in response to the second surface separation distance 1003 being less than or equal to a second surface threshold. For example, the robotic cleaner 1000 may include a displaceable bumper that is configured to move, actuating one or more sensors, in response to the displaceable bumper engaging (e.g., contacting) the second vertically extending surface 1008. In response to the displaceable bumper being displaced, the robotic cleaner 1000 may be configured to determine that the second surface separation distance 1003 is less than or equal to the second surface threshold. Additionally, or alternatively, the robotic cleaner 1000 may include one or more distance sensors configured to measure a distance to the second vertically extending surface 1008. When the robotic cleaner 1000 includes one or more distance sensors, the robotic cleaner 1000 may not contact the second vertically extending surface 1008.

Figure 10C:
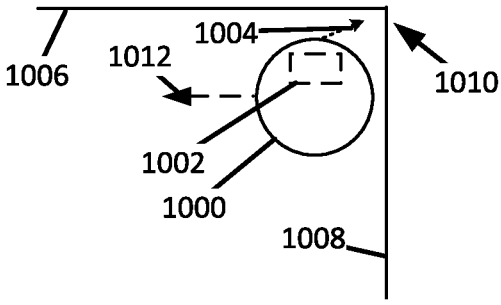
FIG. 10C is a schematic example of the robotic cleaner of FIG. 10A at a different point in time, consistent with embodiments of the present disclosure.

With reference to FIG. 10C, the robotic cleaner 1000, while generating the air jet 1004, may be caused to move in a rearward direction of movement 1012 for a predetermined rearward movement distance. For example, the robotic cleaner 1000 may be caused to move in the rearward direction of movement 1012 when the second surface separation distance 1003 is insufficient to enable to the robotic cleaner 1000 to rotate without the robotic cleaner 1000 engaging the second vertically extending surface 1008. Such a configuration may prevent or mitigate a risk of the robotic cleaner 1000 damaging the second vertically extending surface 1008.

Figure 10D:
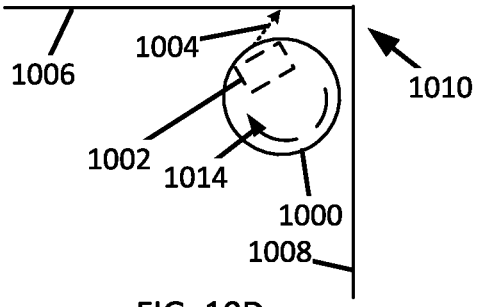
FIG. 10D is a schematic example of the robotic cleaner of FIG. 10A at a different point in time, consistent with embodiments of the present disclosure.

With reference to FIG. 10D, the robotic cleaner 1000 may be caused to rotate, while generating the air jet 1004 in a first rotation direction 1014. Rotation in the first rotation direction 1014 is configured to cause the forward direction of movement 1001 to initially move away from the corner region 1010, wherein continued rotation in the first rotation direction 1014 results in the forward direction of movement 1001 moving toward the corner region 1010. For example, the robotic cleaner 1000 may be caused to rotate in the first rotation direction 1014 until the forward direction of movement 1001 intersects the corner region 1010. By way of further example, the robotic cleaner 1000 may be caused to rotate in the first rotation direction 1014 such that the forward direction of movement 1001 intersects the first or second vertically extending surface 1006 or 1008. By way of still further example, the robotic cleaner 1000 may rotate in the first rotation direction 1014 for a rotation angle of about 330°. By way of still further example, the robotic cleaner 1000 may rotate in the first rotation direction 1014 for a rotation angle of about 315°.

Figure 10E:
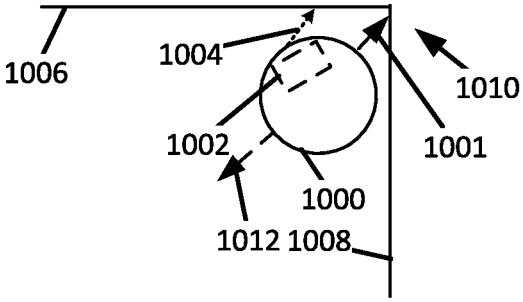
FIG. 10E is a schematic example of the robotic cleaner of FIG. 10A at a different point in time, consistent with embodiments of the present disclosure.

With reference to FIG. 10E, in response to completing rotation in the first rotation direction 1014, the robotic cleaner 1000 may be caused to move in the forward direction of movement 1001 while generating the air jet 1004. For example, the robotic cleaner 1000 may be caused to move in the forward direction of movement 1001 until the robotic cleaner 1000 engages with the first and the second vertically extending surfaces 1006 and 1008. In response to engaging with the first and second vertically extending surfaces 1006 and 1008, the robotic cleaner 1000 may be caused to move in the rearward direction of movement 1012 until the robotic cleaner 1000 comes out of engagement with the first and second vertically extending surfaces 1006 and 1008.

Figure 10F:
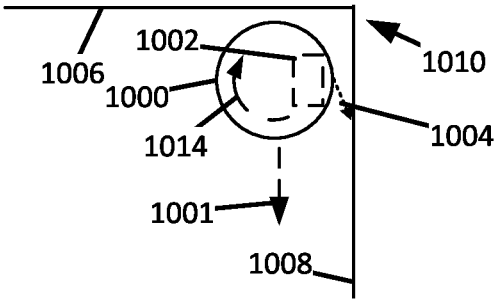
FIG. 10F is a schematic example of the robotic cleaner of FIG. 10A at a different point in time, consistent with embodiments of the present disclosure.

With reference to FIG. 10F, in response to the robotic cleaner 1000 coming out of engagement with the first and second vertically extending surfaces 1006 and 1008, the robotic cleaner 1000 is caused to rotate in the first rotation direction 1014 while generating the air jet 1004. For example, the robotic cleaner 1000 may rotate in the first rotation direction 1014 until the forward direction of movement 1001 is substantially parallel with the second vertically extending surface 1008. By way of further example, the robotic cleaner 1000 may rotate in the first rotation direction 1014 for a rotation angle of about 120°. By way of still further example, the robotic cleaner 1000 may rotate in the first rotation direction 1014 for a rotation angle of about 135°.

Figure 10G:
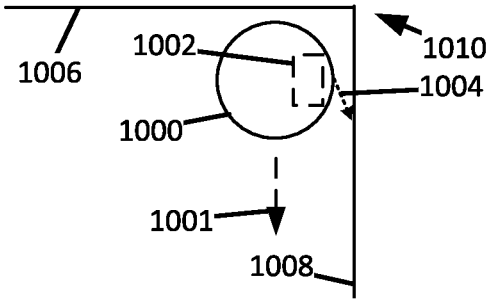
FIG. 10G is a schematic example of the robotic cleaner of FIG. 10A at a different point in time, consistent with embodiments of the present disclosure.

With reference to FIG. 10G, in response to rotating in the first rotation direction 1014 for a second time (e.g., such that the forward direction of movement 1001 is substantially parallel with the second vertically extending surface 1008), the robotic cleaner 1000 is caused to follow the second vertically extending surface 1008 while generating the air jet 1004.

Figure 11:
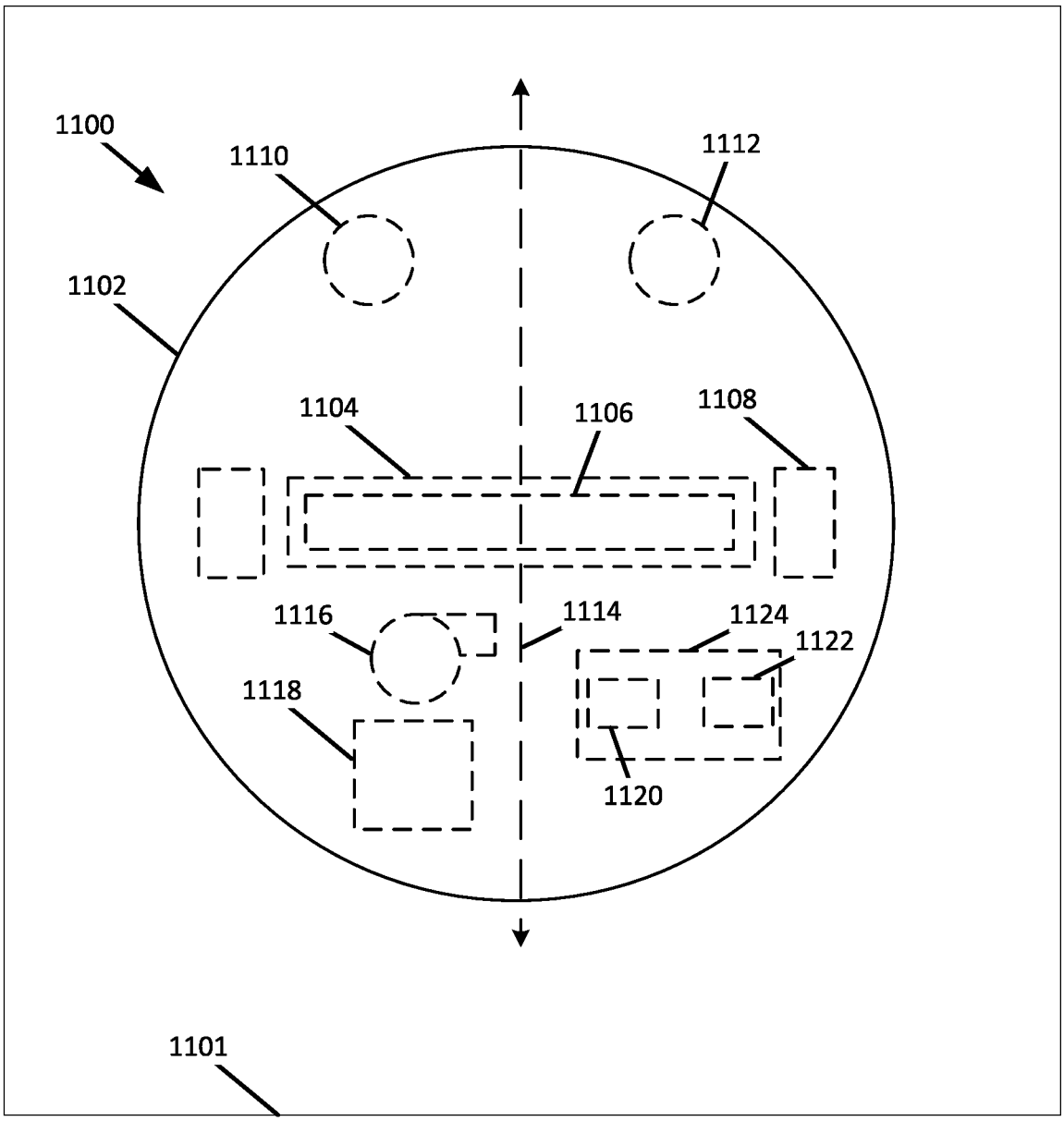
FIG. 11 is a schematic example of a robotic cleaner having first and second side brushes, consistent with embodiments of the present disclosure.

FIG. 11 shows a schematic example of a robotic cleaner 1100. The robotic cleaner 1100 includes a body 1102 having an agitator chamber 1104 (shown in hidden lines) that is configured to receive one or more agitators 1106 (shown in hidden lines), and one or more driven wheels 1108 (shown in hidden lines) configured to urge the robotic cleaner 1100 across a surface to be cleaned 1101 (e.g., a floor). The robotic cleaner 1100 includes a first side brush 1110 (shown in hidden lines) and a second side brush 1112 (shown in hidden lines), the first and second side brushes 1110 and 1112 being disposed on opposing sides of a central axis 1114. The central axis 1114 extends parallel to a forward direction of movement of the robotic cleaner 1100 (e.g., extends perpendicular to a rotation axis of the one or more driven wheels 1108). The first and second side brushes 1110 and 1112 are configured to rotate about a rotation axis that extends substantially perpendicular to the surface to be cleaned 1101. In some instances, the robotic cleaner 1100 may not include any air jet assemblies configured to generate an air jet. In these instances, the robotic cleaner 1100 may be generally referred to as a side brush only robotic cleaner. A suction motor 1116 (shown in hidden lines) is fluidly coupled to the agitator chamber 1104 and configured to urge air to flow into the agitator chamber 1104. A dust cup 1118 (shown in hidden lines) may be fluidly coupled to the suction motor 1116 and the agitator chamber 1104 such that at least a portion of debris entrained within air flowing into the agitator chamber 1104 is deposited in the dust cup 1118.

FIGS. 12-15 show a schematic example of the robotic cleaner 1100 executing a method of cleaning proximate to a vertically extending surface at a corner region 1208 (e.g., a region where a first and second obstacle 1202 and 1204 intersect). One example of the corner region 1208 may include a region defined at the intersection of a first wall with a second wall (e.g., a region where the first and second walls intersect at a substantially perpendicular angle). One or more steps of the method shown in FIGS. 12-15 may be embodied as one or more instructions stored in one or more memories (e.g., one or more non-transitory memories 1120 of FIG. 11), wherein the one or more instructions are configured to be executed on one or more processors (e.g., one or more processors 1122 of FIG. 11). For example, a controller 1124 may be configured to cause one or more steps of the method to be carried out. Additionally, or alternatively, one or more steps of the method may be carried out in any combination of software, firmware, or circuitry (e.g., an application-specific integrated circuit).

Figure 12:
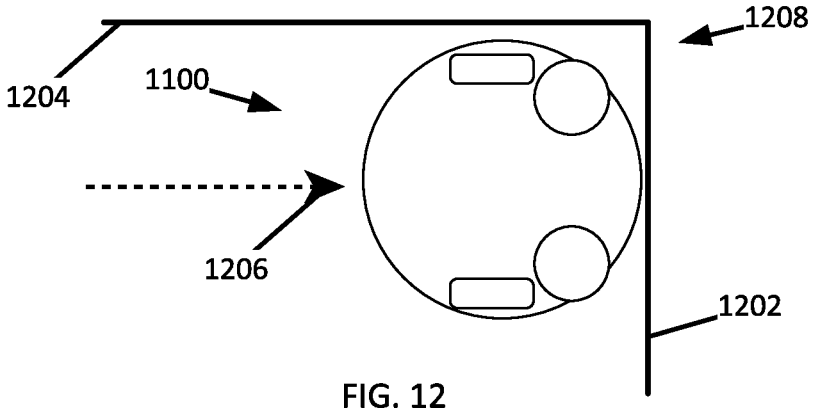
FIG. 12 is a schematic example of the robotic cleaner of FIG. 11 configured to traverse a corner region, consistent with embodiments of the present disclosure.

As shown in FIG. 12, the robotic cleaner 1100 is traveling according to a forward movement direction 1206 in a direction of the corner region 1208 (e.g., in a direction substantially parallel to the second obstacle 1204). The corner region 1208 is defined by the first obstacle 1202 and the second obstacle 1204 (e.g., at an intersection of the first and second obstacle 1202 and 1204). The robotic cleaner 1100 can be configured to detect the first obstacle 1202 using at least one sensor as the robotic cleaner 1100 approaches the first obstacle 1202. As shown, the robotic cleaner 1100 is brought into engagement (e.g., contact) with the first obstacle 1202 while following the second obstacle 1204. For example, the robotic cleaner 1100 may engage the first obstacle 1202 such that a displaceable bumper of the robotic cleaner 1100 is displaced, actuating one or more tactile switches. When traveling toward the first obstacle 1202 both the first and second side brushes 1110 and 1112 may be caused to rotate.

Figure 13:
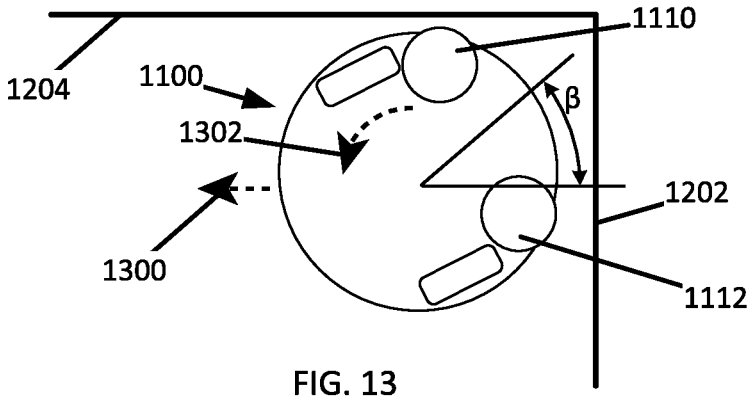
FIG. 13 is a schematic example of the robotic cleaner of FIG. 12 at a different point in time, consistent with embodiments of the present disclosure.

As shown in FIG. 13, in response engaging the first obstacle 1202 (e.g., in response to the displaceable bumper actuating one or more tactile switches), the robotic cleaner 1100 is caused to disable at least one of the first and second side brushes 1110 and/or 1112 (e.g., the side brush closest the second obstacle 1204) and move in a rearward movement direction 1300 for a predetermined distance and/or for a predetermined time, the rearward movement direction 1300 being opposite the forward movement direction 1206. Movement in the rearward movement direction 1300 for the predetermined distance and/or for the predetermined time may be, for example, sufficient to allow the robotic cleaner 1100 to rotate relative to the first and second obstacles 1202 and 1204 (e.g., without contacting the obstacles 1202 and 1204). After moving in the rearward movement direction 1300 for the predetermined distance and/or for the predetermined time, the robotic cleaner 1100 is caused to rotate according to a first rotation direction 1302 (e.g., counterclockwise) through a rotation angle β and/or for a predetermined time. The rotation angle β may be, for example, in a range of 15° to 45°. By way of further example, the rotation angle β may be about 30°. By way of further example, the rotation angle β may be about 45°.

As shown, when rotating through the rotation angle β in the first rotation direction 1302 and/or for the predetermined time, the first side brush 1110 of the robotic cleaner 1100 is caused to first (or initially) approach the second obstacle 1204 and the second side brush 1112 of the robotic cleaner 1100 is caused to first (or initially) approach the first obstacle 1202. In some instances, one or more of the first and/or second side brushes 1110 and 1112 may come into engagement (e.g., contact) with the first and second obstacles 1202 and 1204.

Figure 14:
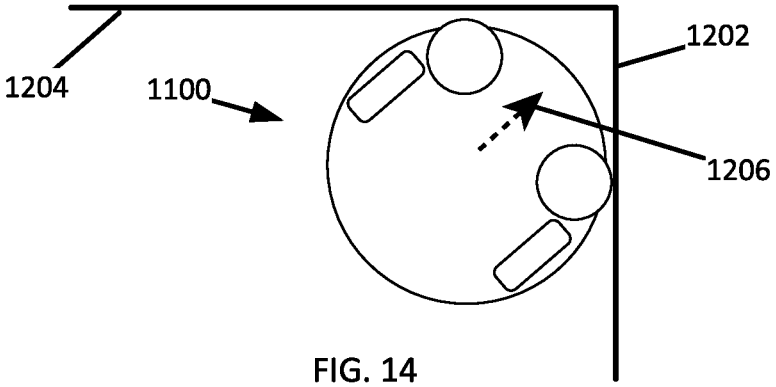
FIG. 14 is a schematic example of the robotic cleaner of FIG. 12 at a different point in time, consistent with embodiments of the present disclosure.

As shown in FIG. 14, after rotating through the rotation angle β and/or for the predetermined time in the first rotation direction 1302, the robotic cleaner 1100 is caused to re-enable the disabled side brush(es) 1110 and/or 1112 such that both side brushes 1110 and 1112 are enabled and the robotic cleaner 1100 is caused move according to the forward movement direction 1206 until the robotic cleaner 1100 comes into engagement (e.g., contact) with the first and second obstacles 1202 and 1204. For example, the robotic cleaner 1100 may continue to move in the forward movement direction 1206 until a displaceable bumper of the robotic cleaner 1100 is displaced, actuating one or more tactile switches. In some instances, after contacting the first and second obstacles 1202 and 1204, the robotic cleaner 1100 may move in a reverse movement direction until the robotic cleaner 1100 comes out of engagement with the first and second obstacles 1202 and 1204.

Figure 15:
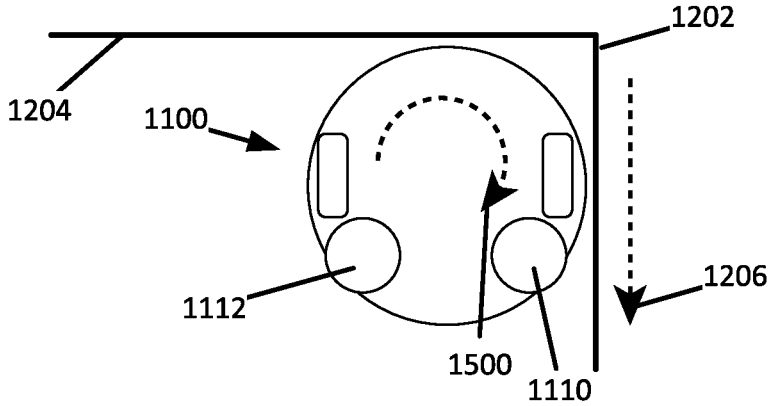
FIG. 15 is a schematic example of the robotic cleaner of FIG. 12 at a different point in time, consistent with embodiments of the present disclosure.

As shown in FIG. 15, after the robotic cleaner 1100 has moved into engagement with the first and second obstacles 1202 and 1204, the robotic cleaner 1100 is caused to rotate in a second rotation direction 1500 (e.g., clockwise) while both side brushes 1110 and 1112 are enabled, the second rotation direction 1500 being opposite the first rotation direction 1302. As the robotic cleaner 1100 rotates according to the second rotation direction 1500, the first and second side brushes 1110 and 1112 are configured to urge debris adjacent the first and second obstacles 1202 and 1204 towards a movement path of a suction inlet of the robotic cleaner 1100. As shown, the robotic cleaner 1100 continues to rotate according the second rotation direction 1500 until the forward movement direction 1206 of the robotic cleaner 1100 is substantially parallel to at least a portion of the first obstacle 1202, allowing the robotic cleaner 1100 to move along (or follow) a perimeter of the first obstacle 1202.

An example of a robotic cleaner, consistent with the present disclosure, may include one or more driven wheels, one or more sensors configured to detect one or more features of an environment, an air jet assembly configured to generate an air jet, and a side brush, a side brush operational state of the side brush corresponding to an air jet operational state of the air jet assembly.

In some instances, the robotic cleaner may further include a fan fluidly coupled to the air jet assembly. In some instances, operation of the fan may be based, at least in part, on outputs generated by the one or more sensors. In some instances, the robotic cleaner may further include a suction motor, wherein an exhaust side of the suction motor is fluidly coupled to the air jet assembly. In some instances, the one or more sensors may be configured to detect a presence of a vertically extending surface. In some instances, the air jet assembly may be caused to generate the air jet when the one or more sensors detect the presence of a vertically extending surface. In some instances, the air jet assembly may be caused not to generate the air jet when the one or more sensors do not detect the presence of the vertically extending surface. In some instances, the side brush and the air jet assembly may be disposed on a common side of the robotic cleaner. In some instances, the air jet generated by the air jet assembly may extend outwardly from the robotic cleaner. In some instances, the air jet may extend forwardly and downwardly. In some instances, the side brush operational state may correspond to the air jet operational state when the robotic cleaner traverses a corner. In some instances, the side brush operational state may correspond to the air jet operational state when the robotic cleaner follows a wall.

Another example of a robotic cleaner, consistent with the present disclosure may include an agitator chamber, a dust cup, a suction motor fluidly coupled to the agitator chamber and the dust cup, one or more sensors configured to detect one or more features of an environment, an air jet assembly configured to generate an air jet, a fan fluidly coupled to the air jet assembly, operation of the fan being based, at least in part, on outputs generated by the one or more sensors, and a controller configured to cause the robotic cleaner to clean an intersection of two vertically extending surfaces.

In some instances, while the air jet assembly is generating the air jet, the controller may be configured to cause the robotic cleaner to move according to a forward direction of movement, following a first vertically extending surface while approaching a second vertically extending surface, decreasing a second surface separation distance. In some instances, when the second surface separation distance is less than or equal to a second surface threshold, the controller may be configured to cause the robotic cleaner to discontinue movement according to the forward direction of movement. In some instances, the controller may be configured to cause the robotic cleaner to rotate in a first rotation direction. In some instances, the controller may be configured to cause the robotic cleaner to rotate in a second rotation direction, the second rotation direction being different from the first rotation direction. In some instances, prior to the robotic cleaner rotating in the first rotation direction, the air jet assembly may discontinue generation of the air jet. In some instances, the controller may be configured to cause the robotic cleaner to follow the second vertically extending surface after rotating in the first rotation direction. In some instances, prior to rotating in the second rotation direction, the air jet assembly may discontinue generation of the air jet. In some instances, the controller may be configured to cause the robotic cleaner to follow the second vertically extending surface after rotating in the second rotation direction. In some instances, the robotic cleaner may further include a side brush, a side brush operational state of the side brush corresponding to an air jet operational state of the air jet assembly. In some instances, the air jet generated by the air jet assembly may extend outwardly from the robotic cleaner, downwardly, and forwardly.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present invention, which is not to be limited except by the claims.

What is claimed is:

1. A robotic cleaner comprising:

an agitator chamber;

a dust cup;

a suction motor fluidly coupled to the agitator chamber and the dust cup, the suction motor configured to urge air into the dust cup;

one or more sensors configured to detect one or more features of an environment;

an air jet assembly configured to generate an air jet;

a fan fluidly coupled to the air jet assembly and configured to urge air to flow through the air jet assembly to generate the air jet, operation of the fan being based, at least in part, on an output generated by the one or more sensors, wherein the suction motor and the fan do not cooperate to urge air into the air jet assembly; and a controller configured to cause the robotic cleaner to carry out a corner cleaning behavior in response to the robotic cleaner reaching a corner formed between a first vertically extending surface and a second vertically extending surface, the corner cleaning behavior including:

following, while generating the air jet, the first vertically extending surface according to a forward direction of movement, the forward direction of movement intersecting the second vertically extending surface;

discontinuing movement in the forward direction and discontinuing generation of the air jet in response to a separation distance between the robotic cleaner and the second vertically extending surface being less than or equal to a threshold; and after discontinuing movement in the forward direction and while generation of the air jet is discontinued, rotating according to a first rotation direction.

2. The robotic cleaner of claim 1, wherein the controller is configured to cause the robotic cleaner to rotate in a second rotation direction, the second rotation direction being different from the first rotation direction.

3. The robotic cleaner of claim 2, wherein the controller is configured to cause the robotic cleaner to follow the second vertically extending surface after rotating in the second rotation direction.

4. The robotic cleaner of claim 1, wherein the controller is configured to cause the robotic cleaner to follow the second vertically extending surface after rotating in the first rotation direction.

5. The robotic cleaner of claim 1 further comprising a side brush, wherein the side brush is caused to rotate when the fan is enabled and the side brush is disabled when the fan is disabled.

6. The robotic cleaner of claim 1, wherein the air jet generated by the air jet assembly extends outwardly from the robotic cleaner, downwardly, and forwardly.

* * * * *